US011285522B2

(12) United States Patent
Nakaura et al.

(10) Patent No.: US 11,285,522 B2
(45) Date of Patent: Mar. 29, 2022

(54) HEAT TRANSFER TUBE, HEAT EXCHANGER, AND METHOD FOR MANUFACTURING HEAT TRANSFER TUBE

(71) Applicant: Mitsubishi Aluminum Co., Ltd., Minato-ku (JP)

(72) Inventors: Yusuke Nakaura, Susono (JP); Yuki Hateruma, Susono (JP); Hideo Kume, Susono (JP); Takuya Okawa, Susono (JP)

(73) Assignee: Mitsubishi Aluminum Co., Ltd., Minato-ku (JP)

( * ) Notice: Subject to any disclaimer, the term of this patent is extended or adjusted under 35 U.S.C. 154(b) by 279 days.

(21) Appl. No.: 16/464,537

(22) PCT Filed: Nov. 30, 2017

(86) PCT No.: PCT/JP2017/043068
§ 371 (c)(1),
(2) Date: May 28, 2019

(87) PCT Pub. No.: WO2018/101406
PCT Pub. Date: Jun. 7, 2018

(65) Prior Publication Data

US 2019/0344318 A1 Nov. 14, 2019

(30) Foreign Application Priority Data

Nov. 30, 2016 (JP) ..... JP2016-233686

(51) Int. Cl.
*B21C 1/22* (2006.01)
*C23C 10/28* (2006.01)
(Continued)

(52) U.S. Cl.
CPC ..... *B21C 1/22* (2013.01); *C23C 4/08* (2013.01); *C23C 4/18* (2013.01); *C23C 10/28* (2013.01);
(Continued)

(58) Field of Classification Search
CPC .. B21C 1/22; B21C 37/20; C23C 4/08; C23C 4/18; C23C 10/28; F28F 1/12; F28F 1/40; F28F 21/08; F28F 21/089
(Continued)

(56) References Cited

U.S. PATENT DOCUMENTS 3,665,573 A * 5/1972 Werner ..... B21C 37/30 29/890.032
4,766,751 A 8/1988 Ueda et al.
(Continued)

FOREIGN PATENT DOCUMENTS

JP 52-9862 1/1977
JP 62-240108 A 10/1987
(Continued)

OTHER PUBLICATIONS

English translation of JP 2016-003802 (cited in the PCT and applicants IDS).*
(Continued)

*Primary Examiner* — Joel M Attey
(74) *Attorney, Agent, or Firm* — Oblon, McClelland, Maier & Neustadt, L.L.P.

(57) ABSTRACT

A heat transfer tube is made of aluminum and includes a streak-shaped Zn diffusion layer (6, 106) which is spirally formed on a circular outer peripheral surface in a length direction. According to this heat transfer tube, even in a case where rainwater or dew concentration water is intensively accumulated in a portion of the outer peripheral surface in a circumferential direction, it is possible to obtain a sufficient corrosion resistance.

11 Claims, 7 Drawing Sheets

(51) Int. Cl.

| | |
|---|---|
| ***C23C 4/08*** | (2016.01) |
| ***C23C 4/18*** | (2006.01) |
| ***F28F 1/12*** | (2006.01) |
| ***F28F 1/40*** | (2006.01) |
| ***F28F 21/08*** | (2006.01) |
| *B21C 37/20* | (2006.01) |

(52) U.S. Cl.
CPC ..... *F28F 1/12* (2013.01); *F28F 1/40* (2013.01); *F28F 21/08* (2013.01); *B21C 37/20* (2013.01)

(58) Field of Classification Search
USPC ..... 428/544
See application file for complete search history.

(56) References Cited

U.S. PATENT DOCUMENTS 6,451,453 B1 * 9/2002 Kucza ..... B32B 15/016 138/140
8,991,481 B2 * 3/2015 Koch ..... B21C 37/14 165/177
9,964,367 B2 * 5/2018 Kimata ..... C09D 5/08

FOREIGN PATENT DOCUMENTS

| | | | |
|---|---|---|---|
| JP | 2000-2396 | A | 1/2000 |
| JP | 2009-178723 | A | 8/2009 |
| JP | 2010-85066 | A | 4/2010 |
| JP | 2012-97920 | A | 5/2012 |
| JP | 2013-11419 | A | 1/2013 |
| JP | 2016-3802 | A | 1/2016 |
| JP | 2017-78202 | A | 4/2017 |
| WO | WO 2014/104371 | A1 | 7/2014 |
| WO | WO 2016/190068 | A1 | 12/2016 |

OTHER PUBLICATIONS

Combined Chinese Office Action and Search Report dated Mar. 27, 2020, in Patent Application No. 201780073521.1, 25 pages (with English translation).
International Search Report dated Feb. 13, 2018 in PCT/JP2017/043068 filed on Nov. 30, 2017.

* cited by examiner

HEAT TRANSFER TUBE, HEAT EXCHANGER, AND METHOD FOR MANUFACTURING HEAT TRANSFER TUBE

TECHNICAL FIELD

The present invention relates to a heat transfer tube having a sacrificial anode layer of Zn in a surface portion incorporated in a heat exchanger for an air conditioner, a heat exchanger, and a method for manufacturing of a heat transfer tube.

Priority is claimed on Japanese Patent Application No. 2016-233686, filed on Nov. 30, 2016, the content of which is incorporated herein by reference.

BACKGROUND ART

In general, in a fin and tube type heat exchanger of an air conditioner or a refrigerator, heat transfer tubes bent in a hairpin shape are inserted into holes of heat sinks arranged at equal pitches, the heat transfer tube is expanded by an expansion plug, and thus, the heat sink and the heat transfer tube are joined to each other. In addition, the fin and tube type heat exchanger is assembled by fitting and brazing U-bend tubes preliminarily bent to tube ends of adjacent hairpin tubes, and thus, the heat exchanger is manufactured.

In the related art, a tube made of a copper alloy is used for a heat transfer tube of a heat exchanger. However, from the viewpoints of depletion of a copper resource, a soaring price of a copper ingot, and recyclability, a heat transfer tube made of aluminum which is lightweight, inexpensive, and highly recyclable is beginning to be used.

A heat exchanger requires an excellent corrosion resistance even under a harsh environment in an area such as a coast including salt in the air, an industrial area containing a corrosive gas in the air, or the like. In general, it is known that an aluminum alloy is corroded in a pitting corrosion form. Under the above-described environment, corrosion is promoted, a through-hole is generated in the heat transfer tube at an early stage, problems such as leakage of a refrigerant and a decrease in a pressure resistance occur, and there is a concern that a function of heat exchanger may be lost. Therefore, when the aluminum alloy is used, a heat transfer tube having a Zn diffusion layer formed on an outer peripheral surface of the tube is used. The corrosion resistance of the heat transfer tube can be improved by applying a sacrificial anode layer of lower potential than the inside to a surface portion of the heat transfer tube made of an aluminum alloy and controlling a distribution state of Zn in a diffusion layer. For example, Patent Document 1 suggests a heat transfer tube made of aluminum which applies a Zn diffusion layer to an outer peripheral surface to improve a corrosion resistance. In general, the Zn diffusion layer is formed by thermally treating a Zn sprayed layer of an outer peripheral surface of a heat transfer tube and thermally diffusing Zn.

CITATION LIST

Patent Document

[Patent Document 1] Japanese Unexamined Patent Application, First Publication 2013-11419

SUMMARY OF INVENTION

Technical Problem

A Zn sprayed layer is formed by thermally spraying Zn to a heat transfer tube or an outer peripheral surface of a raw tube which becomes the heat transfer tube by a thermal spray gun. In this case, the heat transfer tube or the raw tube is conveyed below the fixed thermal spray gun in a longitudinal direction, and a sprayed layer is formed on a surface of the tube in a linear strip shape along the length direction of the tube.

The thermal spray guns can be disposed along a circumferential direction of the heat transfer tube at 180° diagonal with two guns, at 120° diagonal with three guns, and at 90° diagonal with four guns. In addition, naturally, as the number of the thermal spray guns increases, a thermal spray coverage increases, but an equipment cost increases. Originally, thermal spraying of Zn has a poor thermal spraying yield, and as the number of the guns increases, an amount of used Zn and a thermal spraying loss increase, and the cost increases. Therefore, in most cases, a small number of thermal spray guns are used, and in general, two guns or three guns are used. Two sprayed layers are formed in the circumferential direction in two guns, three sprayed layers are formed in three guns, and an unsprayed layer exists between the sprayed layer and the sprayed layer. If four thermal spray guns are used, it is possible to form the sprayed layer around the entire circumference in the circumferential direction. However, it is not realistic for the reasons mentioned above, and inevitably, a portion (unsprayed portion) where Zn is not thermally sprayed is generated in a portion of the outer peripheral surface. Since Zn does not exist in the unsprayed portion, it is necessary to sacrifice-prevent corrosion by a Zn diffusion layer formed in a periphery of the sprayed layer. However, if an extent of the unsprayed portion is wide, an effect of a sacrificial layer becomes difficult to be obtained. In addition, when the heat transfer tube is assembled and used in a heat exchanger, in a case where the heat transfer tube is disposed in a horizontal direction or in a case where the heat transfer tube is disposed to be inclined, rainwater or dew condensation water drips and is easily accumulated in a lower side of the tube. Therefore, the Zn unsprayed portion may be positioned in parallel along a lower side in a longitudinal direction where water is easily accumulated, and in this case, there is a problem that the corrosion resistance becomes worse. In addition, in the case of the Zn thermal spraying, due to a problem of stability of arc, a portion to which many molten droplets adhere during the thermal spraying is formed. In this portion, a Zn concentration on the surface increases after diffusion, and thus, even when the portion has the sprayed layer, conversely, corrosion may progress in the portion.

An object of the present invention is to provide a heat transfer tube having an excellent corrosion resistance.

Solution to Problem

According to an aspect of the present invention, there is provided a heat transfer tube made of aluminum, including: a streak-shaped Zn diffusion layer which is spirally formed on a circular outer peripheral surface along a length direction.

In addition, in the above-described heat transfer tube, the Zn diffusion layer may be provided in a region of 50% or more of the outer peripheral surface.

Moreover, in the above-described heat transfer tube, an average Zn concentration of an entire outer peripheral surface may be 3% to 12%.

In addition, in the above-described heat transfer tube, a maximum Zn concentration of a portion of the outer peripheral surface in a circumferential direction may be 15% or less.

Moreover, in the above-described heat transfer tube, an average diffusion depth of 0.3% Zn concentration may be 80 μm to 285 μm.

In addition, in the above-described heat transfer tube, a lead angle of the Zn diffusion layer which may be spirally formed is 8° or more.

Moreover, in the above-described heat transfer tube, an outer diameter of the tube may be 4 mm to 15 mm, a bottom wall thickness of the tube may be 0.2 mm to 0.8 mm, and a plurality of fins which are spirally formed along the length direction may be provided on an inner peripheral surface of the heat transfer tube.

In addition, in the above-described heat transfer tube, when α indicates an inner peripheral length, β indicates the bottom wall thickness, θ1 indicates a lead angle of the spiral fin, and θ2 indicates the lead angle of the Zn diffusion layer, the following Expression may be satisfied.

$$\tan\theta 2 = \frac{(\alpha + 2\pi\beta)\tan\theta 1}{\alpha}$$

In addition, in the above-described heat transfer tube, the heat transfer tube is inserted into insertion holes of a plurality of heat sinks which may be arranged to be parallel to each other at predetermined intervals, is expanded in a diameter, and thus, is connected to the heat sinks.

Moreover, in the above-described heat transfer tube, the heat transfer tube further including: a partition wall which partitions an inside of the tube into a plurality of flow paths, in which at least one flow path of the plurality of flow paths may extend spirally along the length direction.

According to another aspect of the present invention, there is provided a method for manufacturing a heat transfer tube, comprising: a Zn thermal spraying step of performing Zn thermal spraying on an outer periphery of an aluminum raw tube in a linear streak shape along the length direction, wherein the aluminum raw tube has a plurality of fins linearly extending along a length direction on an inner peripheral surface of the aluminum raw tube; a Zn diffusion step of performing a heat treatment on the aluminum raw tube to diffuse Zn into the aluminum raw tube and forming a Zn diffusion layer; a twisting step of twisting the aluminum raw tube to form the fins and the Zn diffusion layer in a spiral shape along the length direction; and an O-material materializing step (an annealed-aluminum-materializing step) of performing the heat treatment on the twisted aluminum raw tube.

According to still another aspect of the present invention, there is provided a method for manufacturing a heat transfer tube, including: a Zn thermal spraying step of performing Zn thermal spraying on an outer periphery of an aluminum raw tube in a linear streak shape along the length direction, wherein the aluminum raw tube has a plurality of fins linearly extending along a length direction on an inner peripheral surface of the tube; a twisting step of twisting the aluminum raw tube to form the fins and a Zn sprayed layer in a spiral shape along the length direction; and a heat treatment step of performing a heat treatment on the twisted aluminum raw tube to diffuse Zn into the aluminum raw tube, form a Zn diffusion layer, and form an O-materialized aluminum raw tube (an annealed-materialized aluminum raw tube).

In addition, in the above-described method for manufacturing a heat transfer tube, the twisting step may include, using a first drawing die having a first direction as a drawing direction, a second drawing die having a second direction opposite to the first direction as a drawing direction, and a revolution flyer which reverses a pipeline of a tube material between the first drawing die and the second drawing die from the first direction to the second direction and rotates around any one of the first drawing die and the second drawing die, a first twist-drawing step of causing the aluminum raw tube having a plurality of linear grooves formed on an inner surface along the length direction to pass through the first drawing die, winding the aluminum raw tube around the revolution flyer, and revolving the aluminum raw tube to reduce a diameter of the aluminum raw tube and twist the aluminum raw tube so as to form an intermediate twisted tube, and a second twist-drawing step of causing the intermediate twisted tube rotating together with the revolution flyer to pass through the second drawing die to reduce to a diameter of the intermediate twisted tube and twist the intermediate twisted tube.

According to still another aspect of the present invention, there is provided a heat exchanger including: the above-described heat transfer tube; and a heat sink which is connected to the heat transfer tube.

Advantageous Effects of Invention

According to the heat transfer tube of the present invention, the heat transfer tube has an excellent corrosion resistance, and thus, it is possible to use the heat transfer tube for a long period of time even under a harsh environment such as a coast including salt in air.

DESCRIPTION OF EMBODIMENTS

Figure 1:
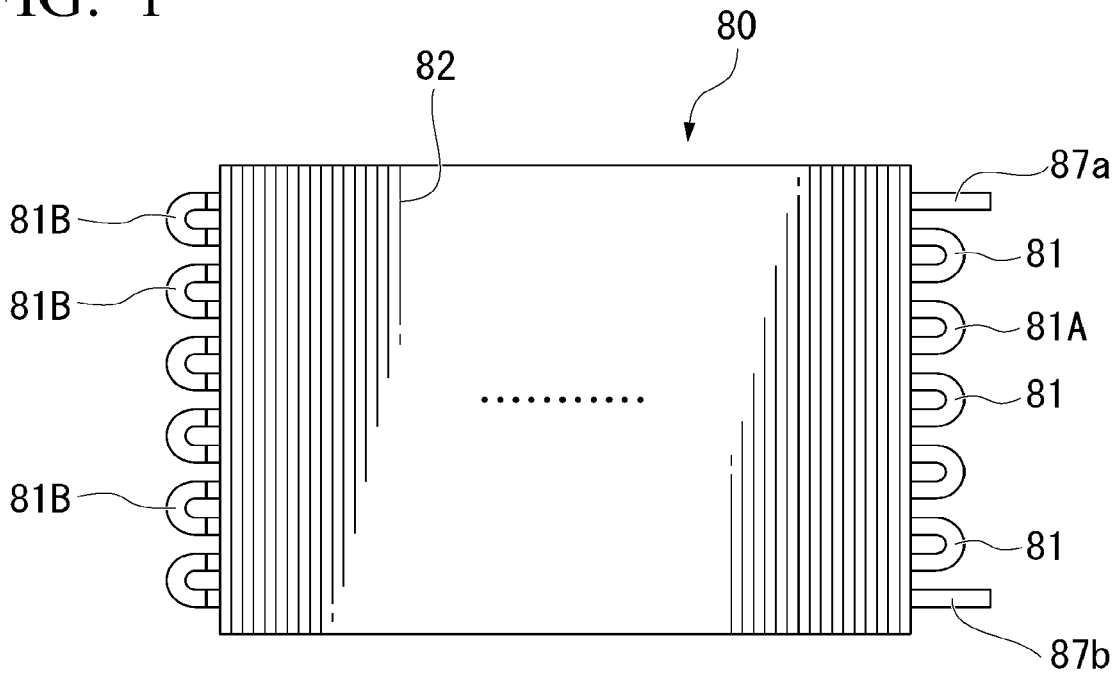
FIG. 1 is a front view of a heat exchanger of a first embodiment.

Hereinafter, embodiments of the present invention will be described with reference to the drawings.

Moreover, in the drawings used in the following descriptions, for the sake of emphasizing a characteristic portion, the characteristic portion may be enlarged for the sake of convenience, and thus, a dimensional ratio of each component is not necessarily the same as an actual dimension ratio. In addition, for the same purpose, some portions which are not characteristic may be omitted for illustration.

First Embodiment

[Heat Exchanger]

Figure 2:
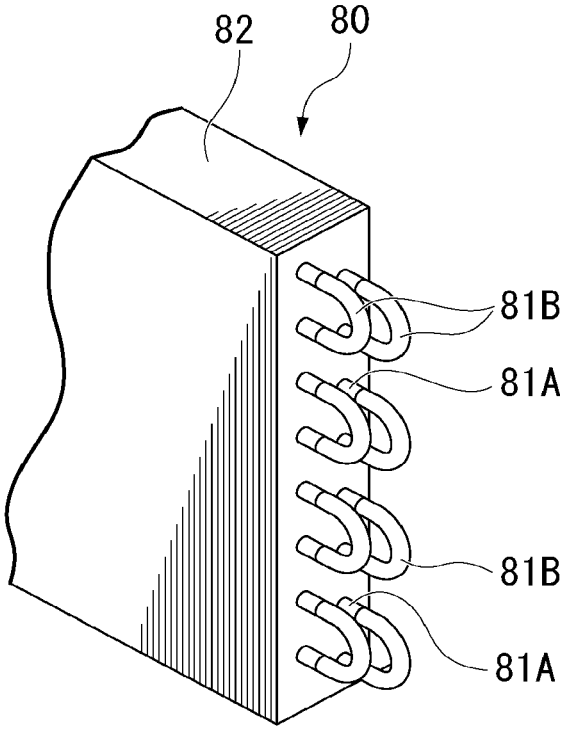
FIG. 2 is a partial perspective view of the heat exchanger of the first embodiment.

FIGS. 1 and 2 are schematic views of a heat exchanger 80 of an embodiment.

In the heat exchanger 80, heat transfer tubes 81 are provided in a serpentine manner as tubes through which a refrigerant passes, and a plurality of aluminum heat sinks 82 are arranged in parallel to each other around the heat transfer tubes 81. Each heat transfer tube 81 is provided to pass through a plurality of insertion holes which are provided so as to penetrate the plurality of heat sinks 82 arranged in parallel to each other.

In the heat exchanger 80, the heat transfer tubes 81 include a plurality of U-shaped main tubes 81A linearly penetrating the heat sinks 82 and U-shaped elbow tubes 81B which connect adjacent end portion openings of adjacent main tubes 81A each other. In addition, an inlet portion 87*a* for the refrigerant is formed on one end portion side of the heat transfer tube 81 penetrating the heat sinks 82, an outlet portion 87*b* for the refrigerant is formed on the other end portion side of the heat transfer tube 81, and thus, the heat exchanger 80 is configured.

Figure 3:
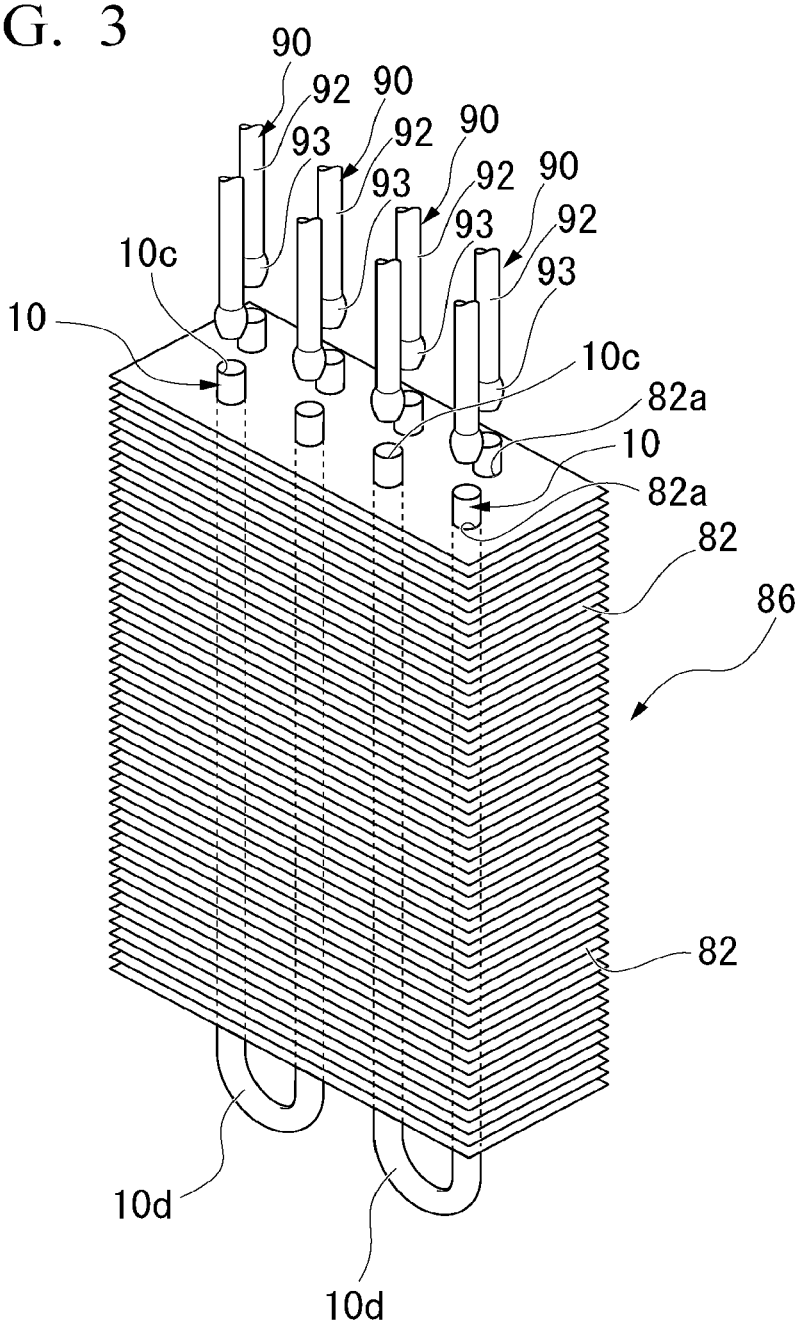
FIG. 3 is a view showing an expansion step of a heat transfer tube which is a manufacturing step of the heat exchanger of the first embodiment.

FIG. 3 is a view showing an expansion step of the heat transfer tube 81.

Hereinafter, in the present specification, the heat transfer tube before being expanded is simply referred to as a heat transfer tube 10, the heat transfer tube after being expanded is referred to as an expanded tube 81, and the terms are used separately.

In the expansion step shown in FIG. 3, in a state where the heat transfer tubes 10 pass through insertion holes 82*a* formed in the plurality of heat sinks 82 arranged in parallel to each other at predetermined intervals, expansion plugs 90 are inserted into the heat transfer tubes 10 to expand the heat transfer tubes, an outer periphery of each heat transfer tube 10 comes into close contact with a top surface of a fin 3 of the insertion hole 82*a* of the heat sink 82, and thus, the heat exchanger is manufactured.

Each expansion plug 90 includes a shaft portion 92 and a head portion 93 which is integrally formed on a tip side of the shaft portion 92.

The head portion 93 has a shell shape and is formed so as to be expanded to have a diameter larger than that of the shaft portion 92. A maximum diameter of the head portion 93 is formed to be larger than a diameter of a circle which connects apexes of the fins 3 of the heat transfer tube 10.

The expansion step using the expansion plug 90 is performed in the following procedure.

First, the plurality of aluminum heat sinks 82 are stacked to constitute a heat sink aggregate 86. In the respective heat sinks 82, the insertion holes 82*a* are formed such that the heat sinks 82 are arranged on a straight line when the heat sinks 82 are stacked with each other.

In addition, the heat transfer tube 10 is bent in a U shape in advance to constitute a hairpin pipe. Accordingly, opening portions 10*c* of the heat transfer tube 10 are aligned on one side, and a U-shaped portion 10*d* is formed on the other side. The hairpin pipes (heat transfer tube 10) of the required number are inserted into the insertion holes 82*a* of the heat sink aggregate 16. The opening portions 10*c* of each heat transfer tube 10 are aligned on one side of the heat sink aggregate 86.

In this state, the expansion plug 90 is forcedly pushed into each heat transfer tube 10 from the opening portion 10*c* of the heat transfer tube 10. As a result, the heat transfer tube 10 is expanded along the outer peripheral surface of the head portion 93 in order from the opening portion 10*c*. The head portion 93 of the expansion plug 90 is forcibly pushed into the heat transfer tube 10 until the head portion 93 reaches near the U-shaped portion 10*d* of the heat transfer tube 10. Accordingly, the head portion 93 of the expansion plug 90 pushes out the heat transfer tube 10 radially outwardly to plastically deform the heat transfer tube 10, and thus, the expanded tube 81 is formed. The expanded tube 81 expands the insertion holes 82*a* of the heat sink 82 and is joined to the insertion holes 82*a*. Finally, the expansion plug 90 is pulled out from the expanded tube 81, and thus, the expansion step is completed.

[Heat Transfer Tube]

Next, the heat transfer tube 10 before being expanded, which is used for manufacturing the above-described heat exchanger 80, will be described.

Figure 4:
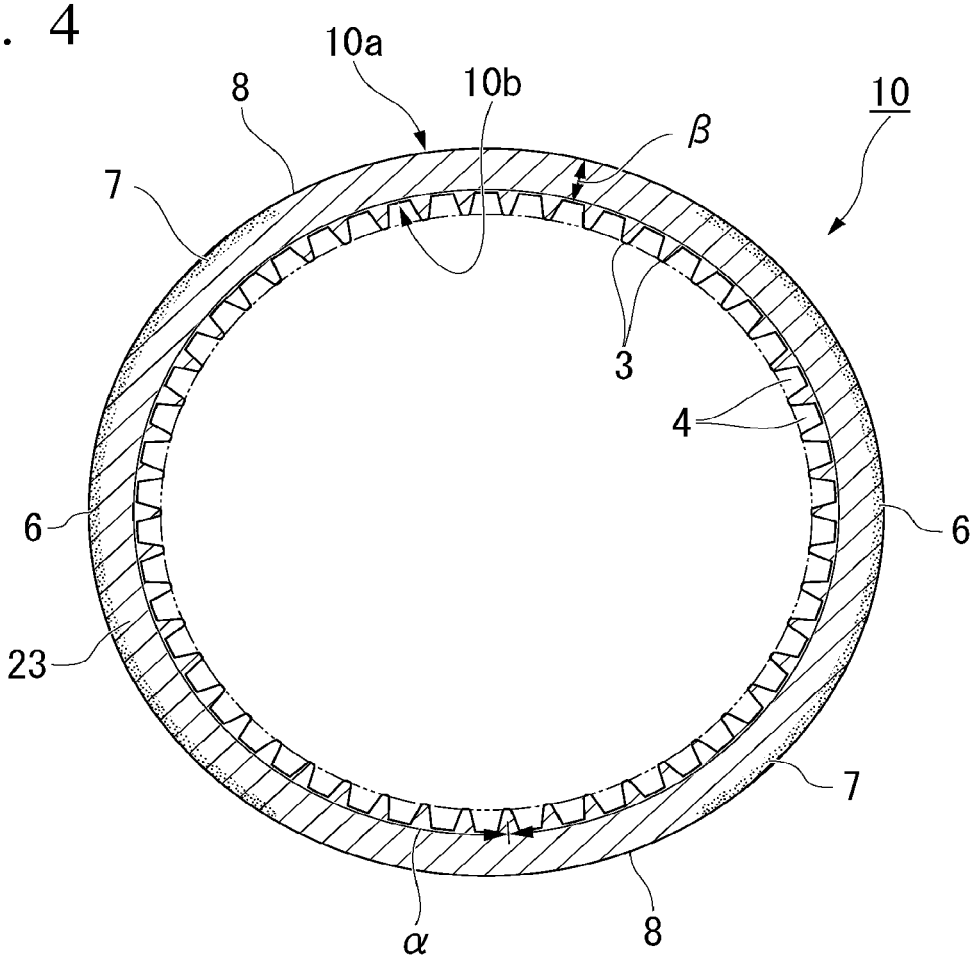
FIG. 4 is a cross section view of the heat transfer tube of the first embodiment.
Figure 5:
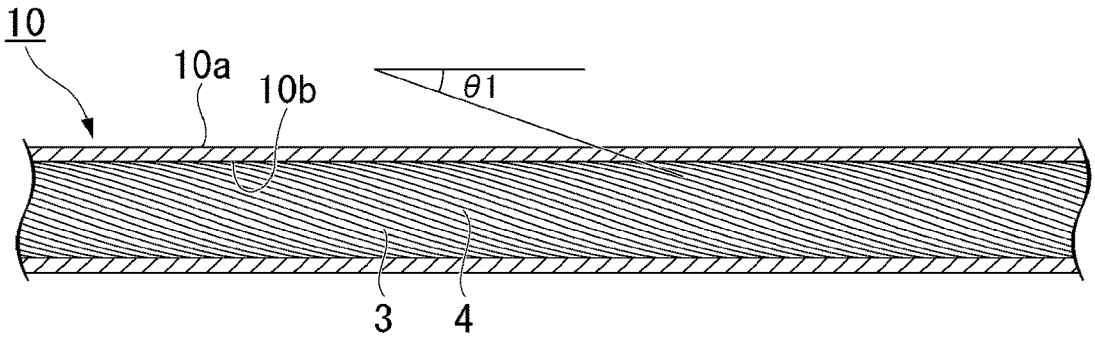
FIG. 5 is a longitudinal section view of the heat transfer tube of the first embodiment.

FIG. 4 is a cross section view of the heat transfer tube 10 of the first embodiment, and FIG. 5 is a longitudinal section view of the heat transfer tube 10.

Figure 6:
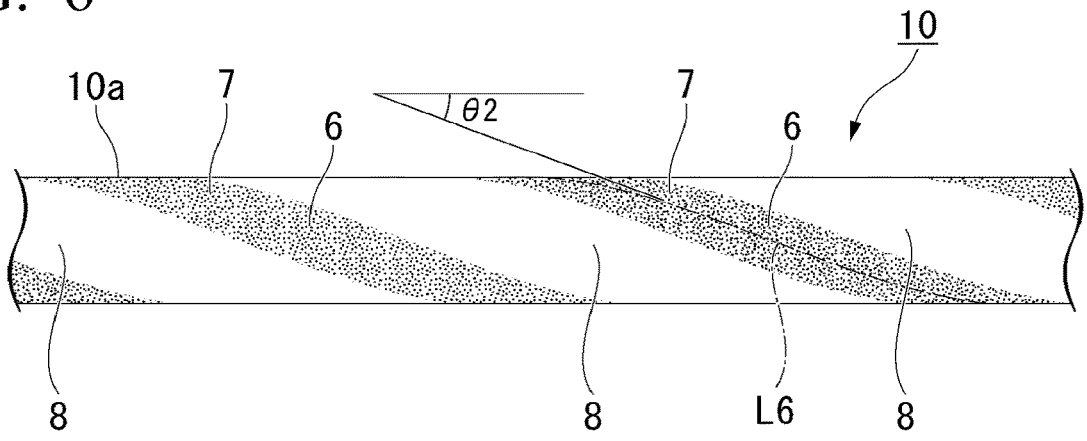
FIG. 6 is a side view of the heat transfer tube of the first embodiment.

In addition, FIG. 6 is a side view of the heat transfer tube 10.

As the heat transfer tube 10, a heat transfer tube made of aluminum or an aluminum alloy can be used. In a case where the heat transfer tube 10 is made of an aluminum alloy, the aluminum alloy is not particularly limited, and a pure aluminum series such as 1050, 1100, 1200, or the like specified by JIS, a 3000 series aluminum alloy typified by 3003 in which Mn is added to these, or the like can be applied to aluminum alloy. Moreover, in addition to these, the heat transfer tube 10 may be formed by using any of the 5000 series to 7000 series aluminum alloys specified by JIS. In addition, in the present specification, the "aluminum" is a concept including an aluminum alloy and pure aluminum.

As shown in FIG. 4, the heat transfer tube 10 is a tubular member having a circular outer cross section. A pair of high Zn regions 7 having a relatively high Zn concentration and a pair of low Zn regions 8 having a relatively low Zn concentration are provided on the outer peripheral surface 10*a* of the heat transfer tube 10. In the outer peripheral surface 10*a*, the high Zn region 7 and the low Zn region 8 are alternately provided in a circumferential direction.

Further, as shown in FIG. 6, in the outer peripheral surface 10 *a*, the high Zn region 7 is provided in a spiral shape along a longitudinal direction. In the high Zn region 7, Zn diffuses radially inward from the outer peripheral surface 10*a* of the heat transfer tube 10 to form a Zn diffusion layer 6. As described above, the high Zn region 7 is formed in a streak-shaped shape spirally in the length direction and at an interval in the circumferential direction. Therefore, the Zn diffusion layer 6 is also formed in a streak-shaped manner spirally along the longitudinal direction of the outer peripheral surface 10*a*.

In order to form the Zn diffusion layer, preferably, Zn is deposited on a surface of heat transfer tube or a surface of the raw tube which is a base of the heat transfer tube by Zn thermal spraying, and thereafter, a diffusion heat treatment is performed on the surface. However, in the heat transfer tube, an unsprayed portion in which Zn does not adhere to a portion of the outer peripheral surface of the heat transfer tube is generated by a thermal spraying method. Particularly, in a heat transfer tube having an outer diameter (diameter) of 4 mm to 15 mm which is optimum for a heat transfer tube for an air conditioner, it is important how to secure a corrosion resistance of the portion where Zn does not exist. Therefore, an optimization of a coverage, a concentration, a diffusion depth of Zn, or the like of the outer peripheral surface 10*a* of the heat transfer tube 10 has been considered. As a result, in the heat transfer tube 10 having an outer diameter of 4 mm to 15 mm, if a Zn coverage on the outer peripheral surface 10*a* is set to 50% or more, an average Zn concentration of the outer peripheral surface 10*a* is set to 3.0 mass % to 12.0 mass %, a depth of the Zn diffusion layer 6 having a Zn concentration of 0.3% from the outer peripheral surface 10*a* is set to a range of 80 μm to 285 μm, and a lead angle of the Zn diffusion layer 6 distributed in two or more bands in the circumferential direction is spiraled to be 8° C. or more, it is founded that a sufficient pitting corrosion resistance can be secured.

That is, in the heat transfer tube 10 of the present embodiment, the streak-shaped Zn diffusion layer 6 formed in a spiral shape along the length direction is provided. In the heat transfer tube 10, the Zn diffusion layer 6 is provided in a region of 50% or more of the outer peripheral surface 10*a*. In the heat transfer tube 10, the average Zn concentration of the outer peripheral surface 10*a* is 3 mass % to 12 mass %. In the heat transfer tube 10, a maximum Zn concentration of a portion along the circumferential direction of the outer peripheral surface 10*a* is 15% or less. In the heat transfer tube 10, an average diffusion depth having the Zn concentration 0.3% of 80 μm to 285 μm. In the heat transfer tube 10, the lead angle of the Zn diffusion layer 6 formed in a spiral shape is 8° or more. Moreover, an outer diameter of the heat transfer tube 10 is 4 mm to 15 mm, and a bottom wall thickness is 0.2 mm to 0.8 mm.

As shown in FIGS. 4 and 5, a plurality of fins (spiral fins) 3 which are formed in a spiral shape in the length direction are provided on an inner peripheral surface 10*b* of the heat transfer tube 10. In addition, a spiral groove 4 is formed between the fins 3. In the present embodiment, for example, 30 to 60 fins 3 are provided. A height (that is, a radial dimension) of each fin 3 is 0.1 mm to 0.3 mm. In addition, a bottom wall thickness d (that is, a thickness of the heat transfer tube 10 corresponding to bottom portions of the spiral grooves 4) of the heat transfer tube 10 is 0.2 mm to 0.8 mm. An apex angle of each fin 3 (an angle between side surfaces of each fin 3) is 10° to 30°.

As described later, the heat transfer tube 10 of the present embodiment is formed by twisting a raw tube 10B (refer to FIG. 7) having the fins 3 and the Zn diffusion layers 6 formed in a linear shape. Therefore, spiral pitches of the spiral Zn diffusion layer 6 and fins 3 coincide with each other. In addition, as shown in FIG. 5, the fins 3 are formed in a spiral shape having a lead angle θ1. Meanwhile, as shown in FIG. 6, the Zn diffusion layer 6 is formed in a spiral shape having a lead angle θ2. When α indicates an inner circumference length and β indicates the bottom wall thickness, the lead angle θ1 of the fin 3 and the lead angle θ2 of the Zn diffusion layer 6 satisfy the following relationship.

$$\tan\theta 2 = \frac{(\alpha + 2\pi\beta)\tan\theta 1}{\alpha}$$

As described above, the lead angle θ2 of the Zn diffusion layer 6 is 8° or more. If the lead angle θ2 of the Zn diffusion layer 6 is less than 8°, a distance between the adjacent Zn diffusion layers 6 increases in the length direction of the outer peripheral surface 10*a* of the heat transfer tube 10, and thus, a sufficient corrosion resistance cannot be obtained. According to the present embodiment, by setting the lead angle θ2 of the Zn diffusion layer 6 to 8° or more, it is possible to provide the heat transfer tube 10 having a high corrosion resistance by sufficiently bringing the Zn diffusion layers 6 arranged in the length direction close to each other.

Moreover, the lead angle θ2 of the Zn diffusion layer 6 is recognized as the lead angle θ2 of an average center line L6 in a width direction of the Zn diffusion layer 6 extending in a streak shape.

As described later, the high Zn region 7 and the Zn diffusion layer 6 formed radially inside the high Zn region 7 are formed by thermally spraying Zn on the surface of the heat transfer tube 10 and further diffusing Zn by a heat treatment. A pitting potential of the Zn diffusion layer 6 is lower than a pitting potential of the inner peripheral surface 10*b* of the heat transfer tube 10 where Zn is not diffused and a pitting potential of a region of on the outer peripheral surface 10*a* where the Zn diffusion layer 6 is not formed. Therefore, a portion (Zn diffusion layer 6) in which Zn is diffused acts as a sacrificial anode layer against a tube material to prevent pitting corrosion and prolong a life span of the entire tube material.

Next, each configuration of the Zn diffusion layer 6 will be described in more detail.

(i) Zn Coverage

In the heat transfer tube 10, the Zn diffusion layer 6 is provided in a region of 50% or more of the outer peripheral surface 10*a*. That is, the coverage of the Zn diffusion layer 6 is 50% or more.

As described above, the Zn diffusion layer 6 of the heat transfer tube 10 acts as a sacrificial material to suppress corrosion of the Zn unsprayed portion and a progress of pitting corrosion into the heat transfer tube 10. If the Zn coverage on the outer peripheral surface 10*a* is less than 50%, it is difficult to prevent the corrosion of the heat transfer tube and deep pitting corrosion occurs. The coverage of 50% can be determined by immersing a heat transfer tube having the Zn diffusion layer 6 in a 10% nitric acid aqueous solution for 10 seconds, taking out and washing the heat transfer tube, and thereafter, measuring a circumferential length of a diffusion portion. The diffusion portion turns black by a reaction with the nitric acid aqueous solution, and the diffusion portion is easily determined visually.

(ii) Maximum Zn Concentration and Average Zn Concentration

The average Zn concentration of the outer peripheral surface 10*a* of the heat transfer tube 10 is set to 3.0 mass % to 12.0 mass %. If the average Zn concentration is less than 3.0 mass %, an anticorrosive effect is small, and thus, there is a concern that a through-hole is generated in the heat transfer tube 10 in a short period of time. Meanwhile, if the average Zn concentration exceeds 12.0 mass %, a corrosion rate increases and a thickness reduction of the heat transfer tube becomes a problem. Here, as described above, the corrosion rate increases in the region where the Zn concentration is high. Therefore, it is preferable to decrease the maximum Zn concentration in the circumferential direction as much as possible and set the maximum Zn concentration to 15.0% or less in order to prevent an increase in the corrosion rate. Moreover, a maximum surface Zn concentration in the low Zn region 8 is less than 3.0 mass %, and most preferably, is 0%. That is, in the present specification, a region of the outer peripheral surface 10*a* of the heat transfer tube 10 in which the Zn concentration is 3.0 mass % or more is referred to as the high Zn region 7, and a region less than 3.0 mass % is referred to as the low Zn region 8.

The maximum Zn concentration and the average Zn concentration on an outer peripheral surface can be obtained as follows.

First, a heat transfer tube is cut to have a suitable length in the longitudinal direction by a nipper, and a material is opened to be developed from a cut surface and is crushed horizontally by a presser to be formed in a plate shape. Thereafter, a plate-like sample is placed so that a cross section perpendicular to an extrusion direction becomes a measurement surface, is filled with a resin, is polished to Emery #1000, and, thereafter, is finished by buffing. The Zn concentration is measured using an Electron Probe Micro Analyzer (EPMA) analyzer. The measurement surface is divided into 72 equally spaced intervals, and a line analysis is performed from a surface layer on the outer peripheral side of each heat transfer tube to the inner peripheral side, and Al strength and the Zn concentration of 70 points are measured at 5 μm pitch. The line analysis is performed with a current of 50 nA, an acceleration voltage of 20 kV, and a measuring time of 50 msec.

From obtained data at each measurement position, a portion where the Al strength exceeds 1000 is referred to as a heat transfer tube surface portion and a concentration of the portion is referred to as the maximum Zn concentration. Also, an average value of 72 points in the circumferential direction is referred to as the average Zn concentration.

(iii) 0.3% Zn Concentration Diffusion Depth

By performing Zn diffusion processing, an area ratio of the portion where Zn does not exist decreases, uniformization of a surface Zn concentration is performed, the corrosion rate is decreased by decreasing the surface Zn concentration, and the corrosion resistance can be secured for a long period of time.

The Zn diffusion layer 6 is a layer in which Zn diffuses into aluminum radially inward from the outer peripheral surface 10*a*. In the Zn diffusion layer 6, the concentration of Zn gradually decreases from the outer peripheral surface 10*a* side to the deeper portion. Preferably, a 0.3% Zn diffusion depth of the Zn diffusion layer 6 is 80 μm to 285 μm. That is, it is preferable that the region where Zn is diffused by 0.3% or more is a region from the outer peripheral surface 10*a* to a depth of 80 μm to 285 μm. By setting the 0.3% Zn diffusion depth to 80 μm to 285 μm, it is possible to sufficiently decrease the corrosion rate.

The 0.3% Zn diffusion depth from the surface layer is measured by the following method.

After performing the analysis in the same way as the measurement of the average Zn concentration, from the obtained data of each measurement position, the portion where the Al strength exceeds 1000 is referred to as the heat transfer tube surface portion, and the Zn concentration from the surface portion is measured in the inner circumferential depth direction. In addition, the depths at the position of the 0.3% Zn concentration are examined in the circumferential direction and averaged. If the depth of the diffusion layer with 0.3% Zn concentration from the surface of the heat transfer tube is less than 80 μm, the diffusion layer will be exhausted at an early stage and the corrosion the heat transfer tube cannot be prevented for a long time. Meanwhile, when the depth of the Zn diffusion layer 6 exceeds 285 μm, the Zn diffusion layer 6 having a lower potential than that of a base material of the heat transfer tube except for the Zn diffusion layer 6 preferentially corrodes compared to the base material. Therefore, the wall thickness of the heat transfer tube decreases, and a decrease in the strength of the heat transfer tube becomes a problem. Accordingly, in the present invention, the depth of the diffusion layer of 0.3% Zn concentration from the surface of the heat transfer tube is set to 80 μm to 285 μm.

In the heat transfer tube 10 of the present embodiment, the Zn diffusion layer 6 is formed in a spiral shape. In general, when a heat transfer tube is assembled to a heat exchanger and used, in a case where the heat transfer tube is disposed in a horizontal direction or when the heat transfer tube is disposed in an inclined state, rainwater or dew condensation water drips and is easily accumulated in a lower side of the tube. According to the present embodiment, in the outer peripheral surface 10*a* of the heat transfer tube 10, the Zn diffusion layers 6 are intermittently disposed at regular intervals along the longitudinal direction. Therefore, even in a case where the rainwater or the dew condensation water is intensively accumulated in a portion of the outer peripheral surface 10*a* in the circumferential direction, it is possible to obtain a sufficient corrosion resistance.

In addition, according to the present embodiment, it is possible to suppress an AVEC phenomenon in which the heat sinks 82 joined together by the expanded tube 81 after being expanded come into close contact with each other or a turbulence phenomenon in which the gaps between the heat sinks 82 become nonuniform. In an aluminum material constituting the heat transfer tube 10, Zn diffuses in the Zn diffusion layer 6, and thus, a tensile strength increases by approximately 10 to 20 MPa. Therefore, in the expansion step, the portion where the Zn diffusion layer 6 is formed becomes harder to be deformed than other portions. According to the present embodiment, since the Zn diffusion layer 6 is provided, a portion which is hardly deformed when the expansion step is performed is formed in a spiral shape. Accordingly, it is possible to prevent the Zn diffusion layer 6 from being unevenly deformed in one direction by performing the expansion step. According to the present embodiment, it is possible to suppress the AVEC phenomenon in which the heat sinks 82 joined together by the expanded tube 81 after being expanded come into close contact with each other or the turbulence phenomenon in which the gaps between the heat sinks 82 become nonuniform.

According to the present embodiment, the plurality of fins 3 formed in a spiral shape along the length direction are provided on the inner peripheral surface 10*b* of the heat transfer tube 10. By forming the spiral fins 3 on the inner peripheral surface 10*b*, it is possible to increase a heat exchange efficiency between the heat transfer tube 10 and a refrigerant liquid flowing through the heat transfer tube 10. The heat transfer tube 10 having the spiral fins 3 can be formed by twisting the raw tube 10B in which the fins extending linearly in the length direction are formed by extrusion processing. In addition, by performing Zn thermal spraying extending in a linear streak shape before the step of applying the twist, it is possible to easily form the spiral Zn diffusion layer 6 after applying the twist.

[Manufacturing Method]

Hereinafter, an embodiment of a method for manufacturing the heat transfer tube 10 according to the present invention will be described with reference to the drawings. The method for manufacturing the heat transfer tube 10 includes an extrusion molding step, a Zn thermal spraying step, a Zn diffusion step, a twisting step, an annealed-aluminum-materializing step. In addition, the Zn diffusion step and annealed-aluminum-materialization step may be performed simultaneously in one heat treatment step. Details of each step will be described below.

<Extrusion Molding Step>

First, the extrusion molding step will be described.

Figure 7:
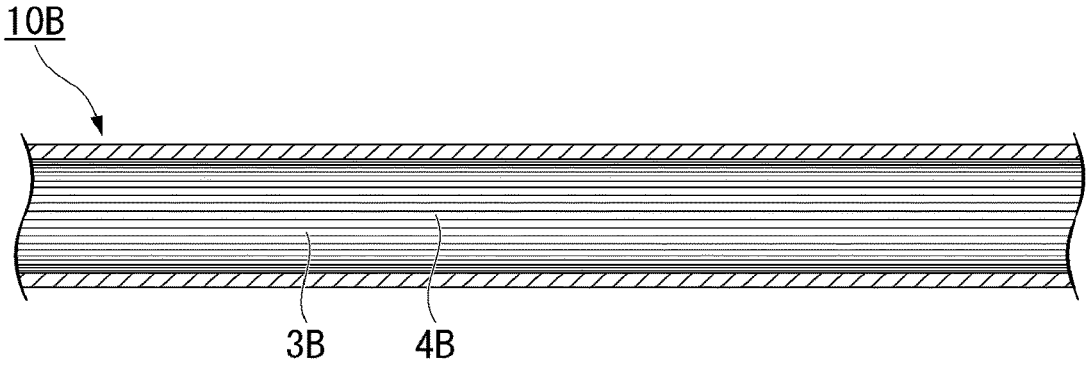
FIG. 7 is a longitudinal section view of a raw tube (straight grooved tube) in a manufacturing method of the first embodiment.

FIG. 7 is a longitudinal section view of the raw tube (the aluminum raw tube) (straight grooved tube) 10B formed by the extrusion molding step.

The raw tube 10B is manufactured by preparing an aluminum alloy billet by a semi-continuous casting method and performing hot extrusion on the prepared aluminum alloy billet. It is preferable to perform a homogenization treatment on the billet for improvement of extrudability. However, good results are obtained for a corrosion resistance regardless of the performance of the homogenization treatment. The step of heating the billet before being hot-extruded can be regarded as doubling the homogenization treatment. An inner surface of the extruded raw tube has a straight groove. As shown in FIG. 7, a raw tube 10B having a plurality of linear grooves 4B along the length direction formed on the inner surface thereof at intervals in the circumferential direction is manufactured (straight grooved tube extrusion step).

<Zn Thermal Spraying Step>

Next, the Zn thermal spraying step will be described. Zn thermal spraying can be used to form a Zn layer on the outer surface of the heat transfer tube. In the Zn thermal spraying step, it is preferable to thermally spray Zn to the raw tube 10B at a high temperature immediately after the extrusion molding using processing heat when the raw tube 10B is extrusion-molded and fix the Zn to the surface. After the thermal spraying of Zn, the raw tube is wound in a coil shape.

Figure 8:
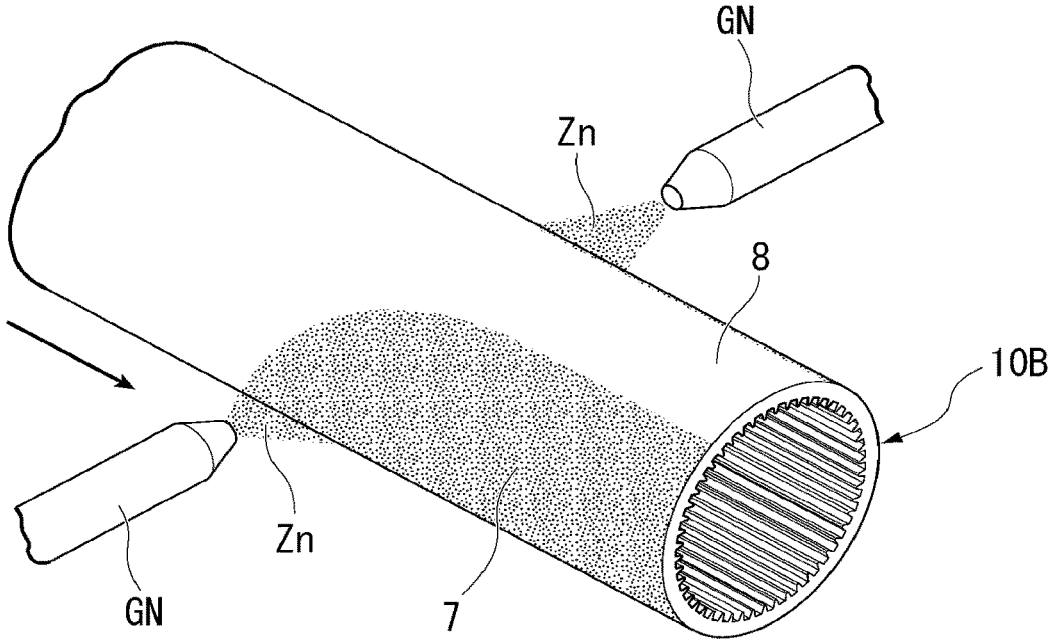
FIG. 8 is a schematic view showing a Zn thermal spraying step in the manufacturing method of the first embodiment.

FIG. 8 is a schematic view showing the Zn thermal spraying step. As shown in FIG. 8, in the Zn thermal spraying step, Zn is thermally sprayed using two guns GN disposed to sandwich the raw tube 10B from both sides in the radial direction while feeding the raw tube 10B in a longitudinal direction thereof. As a result, the Zn thermal spraying is performed in the linear outer streak shape along the length direction on the outer peripheral surface of the raw tube 10B. In the Zn thermal spraying step, surfaces (surfaces facing the guns GN) of the raw tube 10B on which the thermal spraying of Zn is performed become the high Zn region 7 of the heat transfer tube 10. In addition, the surface of the raw tube 10B on which the Zn thermal spraying is not performed becomes the low Zn region 8 of the heat transfer tube 10. That is, in the outer peripheral surface of the raw tube 10B, a Zn adhesion amount decreases and the unsprayed layer is formed in a portion where a thermal spraying direction of Zn and a tangent line are substantially parallel to each other. In order to adhere Zn to this portion, the thermal spraying direction of Zn may be set to a right-left direction. However, as described above, the amount of the used Zn and the thermal spraying loss increase, which further increases the cost. Therefore, it is desirable to control the state to a Zn distribution state in which a maximum effect can be obtained even with a small amount of the Zn thermal spraying. As a Zn thermal spraying method, a general thermal spraying method is suitable. However, a flame thermal spraying method, a plasma thermal spraying method, an arc thermal spraying method, or the like can also be applied.

<Zn Diffusion Step>

Next, the Zn diffusion step will be described.

The Zn diffusion step is a heat treatment step of diffusing the Zn, which is thermally sprayed to the outer peripheral surface of the raw tube 10B in the Zn thermal spraying step, in a thickness direction of the raw tube 10B. A depth of the Zn diffusion layer is changed according to a heating temperature and a holding time. It is necessary to set an optimum condition in consideration of productivity, a variation in a temperature between lots, or the like. Preferably, the heating temperature of the Zn diffusion processing is within a range of 350° C. to 550° C. If the heating temperature is lower than 350° C., the diffusion of the Zn is not sufficiently performed, whereas if the temperature exceeds 550° C., a portion having a large Zn adhesion amount is locally melted, and thus, it is difficult to control the diffusion depth. The holding time is changed according to a target depth of the diffusion layer. However, in order to obtain the depth of the Zn diffusion layer of 80 to 285 μm at the heating temperature, the Zn diffusion layer is held for 0.5 to 12 hours. Preferably, an increase in temperature during the Zn diffusion processing is performed at a rate of 200° C./hr or less such that uniform heating of the heat transfer tube body can be obtained to some extent. In addition, preferably, cooling after the Zn diffusion processing is performed as quickly as possible at a rate of 50° C./hr or more from the heating temperature to 300° C. in order to suppress grain corrosion. Moreover, the Zn diffusion processing may be performed after the twisting processing.

<Twisting Step>

Next, the twisting step will be described.

The twisting step is a step in which the Zn diffusion layer 6, the fins 3B, and the linear grooves 4R are spirally formed by twisting the raw tube 10B while drawing the raw tube 10B.

In the present specification, a tube material (that is, the above-described raw tube 10B) before being twisted is referred to as a "straight grooved tube". In addition, a tube material (that is, the above-described heat transfer tube 10) after being twisted is referred to as an "inner surface spiral groove tube". Moreover, in a process from the straight grooved tube to the inner surface spiral groove tube, an intermediate product which is twisted about half as compared to the inner surface spiral groove tube is called "intermediate twisted tube". In addition, a term "tube material" in the present specification is a superordinate concept of a straight grooved tube, an intermediate twisted tube, and an inner surface spiral groove tube, and means a tube which becomes a processing target irrespective of the stage of the manufacturing step.

In the present specification, a "preceding stage" and a "subsequent stage" mean a front-to-back relationship (that is, upstream and downstream) along a processing order of the tube material, and do not mean an arrangement of respective portions in the device.

The tube material is conveyed from the preceding stage (upstream) side to the subsequent stage (downstream) side in the manufacturing device of the inner surface spiral groove tube. The portions disposed in the preceding stage are not necessarily disposed on a front side, and the portions in the subsequent stages are not necessarily disposed on a rear side.

<Manufacturing Device Performing Twisting Step>

Figure 9:
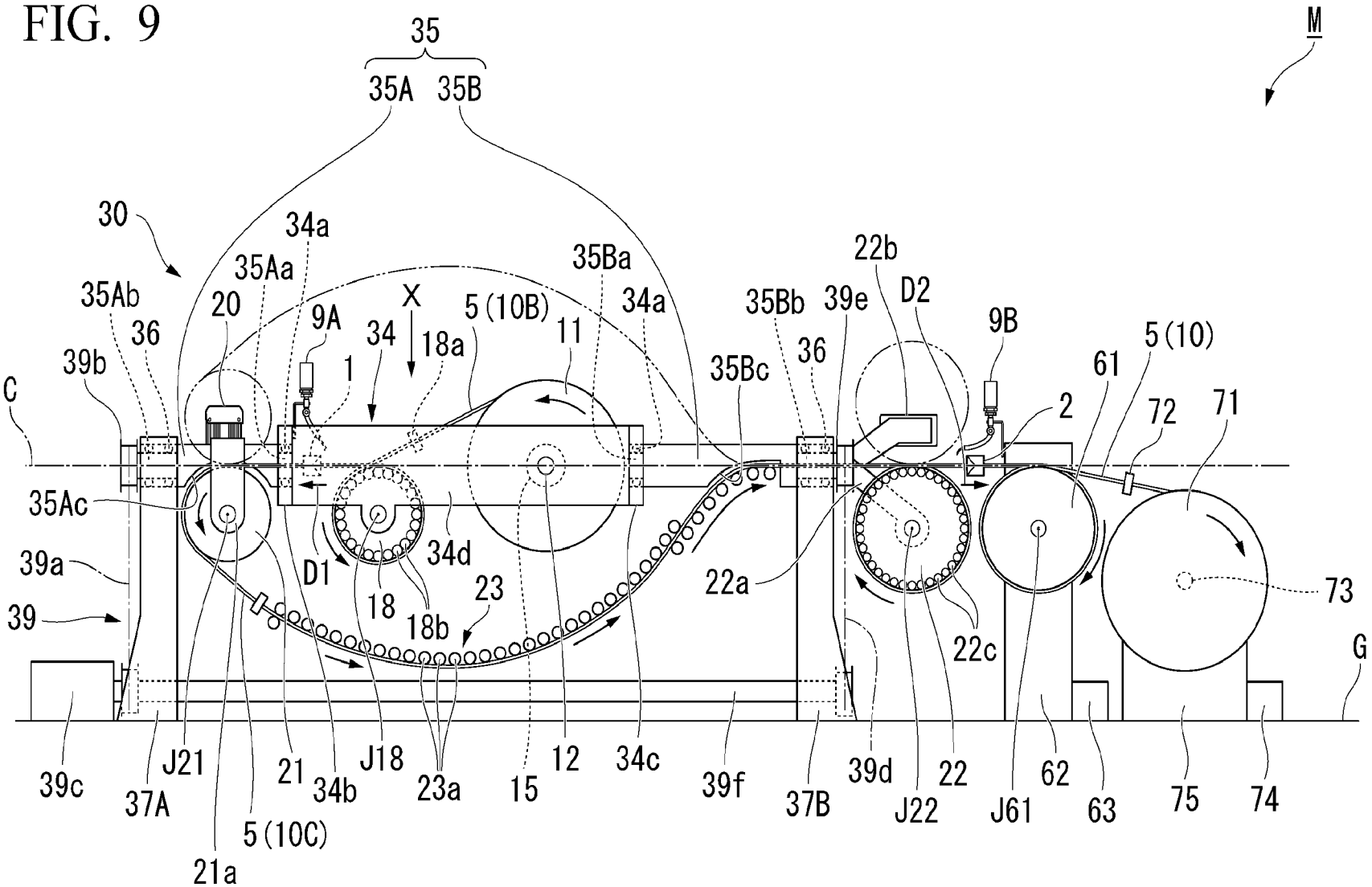
FIG. 9 is a front view showing a manufacturing device which performs a twisting step in the manufacturing method of the first embodiment.

FIG. 9 is a front view showing a manufacturing device M which manufactures the inner surface spiral groove tube (heat transfer tube) 10 by twisting the straight grooved tube (raw tube) 10B twice. First, the manufacturing device M is described, and thereafter, the twisting step using the manufacturing device M is described.

The manufacturing device M includes a revolution mechanism 30, a floating frame 34, an unwinding bobbin (first bobbin) 11, a first guide capstan 18, a first drawing die 1, a first revolution capstan 21, a revolution flyer 23, a second revolution capstan 22, a second drawing die 2, a second guide capstan 61, and a winding bobbin (second bobbin) 71.

Hereinafter, details of each portion will be described in detail.

(Revolution Mechanism) The revolution mechanism 30 has a rotary shaft 35 including a front shaft 35A and a rear shaft 35B, a drive unit 39, a front stand 37A, and a rear stand 37B.

The revolution mechanism 30 rotates the rotary shaft 35, the first revolution capstan 21, the second revolution capstan 22, and the revolution flyer 23 which are fixed to the rotary shaft 35.

In addition, the revolution mechanism 30 maintains a stationary state of the floating frame 34 which is coaxially positioned with the rotary shaft 35 and is supported by the rotary shaft 35. Accordingly, stationary states of the unwinding bobbin 11, the first guide capstan 18, and the first drawing die 1 supported by the floating frame 34 are maintained.

Each of the front shaft 35A and the rear shaft 35*b* has a cylindrical shape whose inside is a hollow. The front shaft 35A and the second rear shaft 35B are coaxially disposed with each other with a revolution center axis C (a pass line of a first drawing die) as a center axis. The front shaft 35A is rotatably supported by the front stand 37A via a bearing 36 and extends rearward (rear stand 37B side) from the front stand 37A. Similarly, the rear shaft 35B is rotatably supported by the rear stand 37B via a bearing and extends forward (front stand 37A side) from the rear stands 37B. The floating frame 34 is bridged between the front shaft 35A and the rear shaft 35B.

The drive unit 39 has a drive motor 39*c*, a linear movement shaft 39*f*, belts 39*a* and 39*d*, and pulleys 39*b* and 39*e*. The drive unit 39 rotates the front shaft 35A and the rear shaft 35B.

The drive motor 39*c* rotates the linear movement shaft 39*f*. The linear movement shaft 39*f* extends in a forward-rearward direction in lower portions of the front stand 37A and the rear stand 37B.

In a front end portion 35Ab of the front shaft 35A, the pulley 39*b* is attached to a tip penetrating the front stand 37A. The pulley 39*b* is interlocked with the linear movement shaft 39*f* via the belt 39*a*. Similarly, in a rear end portion 35Bb of the rear shaft 35B, the pulley 39*e* is attached to a tip penetrating the rear stand 37B and is interlocked with the linear movement shaft 39*f* via the belt 39*d*. Accordingly, the front shaft 35A and the rear shaft 35B synchronously rotate about the revolution center axis C.

The first revolution capstan 21, the second revolution capstan 22, and the revolution flyer 23 are fixed to the rotary shaft 35 (front shaft 35A and rear shaft 35B). The rotary shaft 35 rotates, and thus, the members fixed to the rotary shaft 35 revolve about the revolution center axis C.

(Floating Frame)

The floating frame 34 is supported by end portions 35 Aa and 35 Ba facing each other of the front shaft 35A and the rear shaft 35B of the rotary shaft 35, via bearings 34*a*. In addition, the floating frame 34 supports the unwinding bobbin 11, the first guide capstan 18, and the first drawing die 1.

Figure 10:
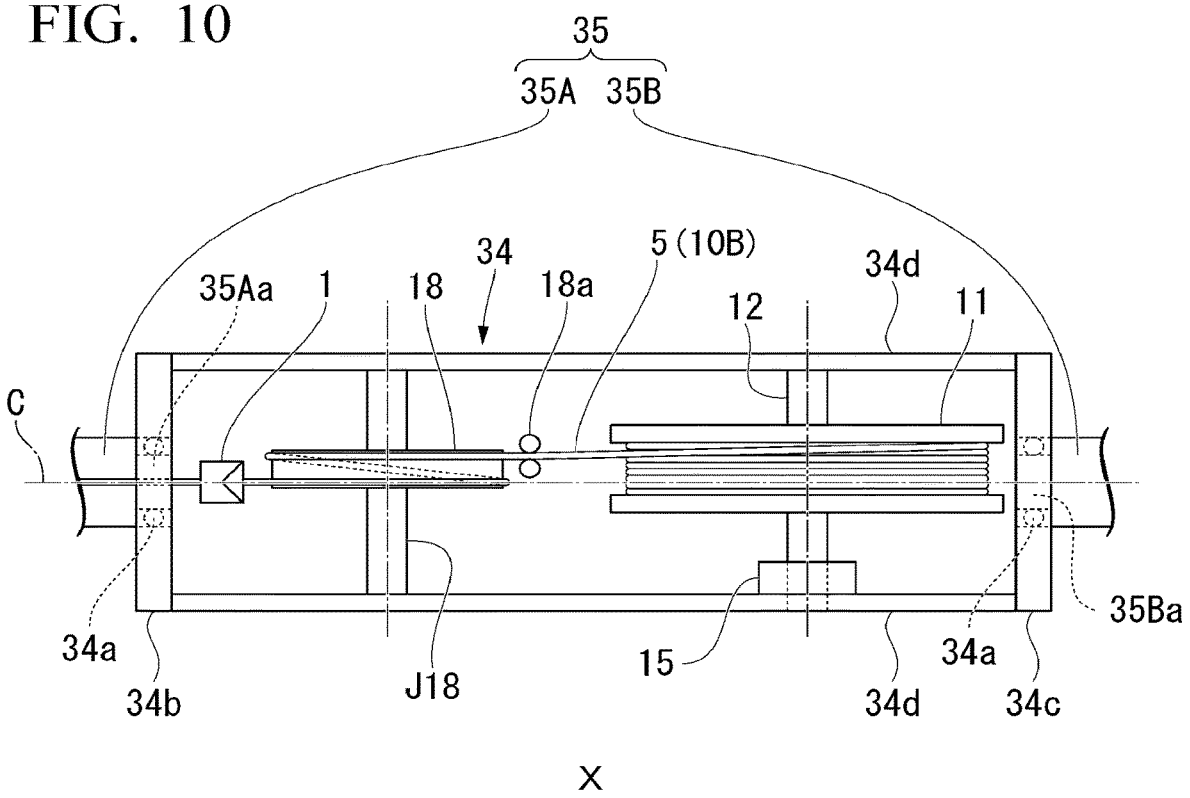
FIG. 10 is a plan view of a floating frame when viewed in an arrow X direction in FIG. 9.

FIG. 10 is a plan view of a floating frame 34 when viewed in an arrow X direction in FIG. 9. As shown in FIGS. 9 and 10, the floating frame 34 has a box shape which is open vertically. The floating frame 34 has a front wall 34*b* and a rear wall 34*c* facing each other in the forward-rearward direction, and a pair of support walls 34*d* which face each other in the right-left direction and extends in the forward-rearward direction.

Through-holes are provided in the front wall 34*b* and the rear wall 34*c*, and the end portions 35Aa and 35Ba of the front shaft 35A and the rear shaft 35B are inserted into the through-holes. The bearings 34*a* are interposed between the end portions 35Aa and 35Ba and the through-holes of the front wall 34*b* and the rear wall 34*c*. Accordingly, a rotation of the rotary shaft 35 (front shaft 35A and rear shaft 35B) is not easily transmitted to the floating frame 34. Even the rotary shaft 35 rotates, a stationary state of the floating frame 34 with respect to a ground G is held. In addition, a weight which biases the center of gravity of the floating frame 34 with respect to the revolution center axis C may be provided to stabilize the stationary state of the floating frame 34.

As shown in FIG. 10, the unwinding bobbin 11, the first guide capstan 18, and the first drawing die 1 are disposed on both sides of the pair of support walls 34*d* in the right-left direction (an upward-downward direction on a paper surface in FIG. 10). The pair of support walls 34*d* rotatably supports a bobbin support shaft 12 holding the unwinding bobbin 11 and a rotary shaft J18 of the first guide capstan 18. In addition, the support walls 34*d* support the first drawing die 1 via a die support (not shown).

(Unwinding Bobbin)

The straight grooved tube 10B (refer to FIG. 7) in which the linear grooves 4B are formed is wound around the unwinding bobbin 11. The unwinding bobbin 11 unwinds the straight grooved tube 10B and supplies the unwound straight grooved tube 10B to the subsequent stage.

The unwinding bobbin 11 is detachably attached to the bobbin support shaft 12.

As shown in FIG. 10, the bobbin support shaft 12 extends in a direction orthogonal to the rotary shaft 35. In addition, the bobbin support shaft 12 is rotatably supported by the floating frame 34. Moreover, here, the "rotation" means that the bobbin support shaft 12 rotates about the center axis of the bobbin support shaft 12. The bobbin support shaft 12 holds the unwinding bobbin 11 and is rotated in a supply direction of the unwinding bobbin 11, and thus, the bobbin support shaft 12 assists feeding of the tube material 5 of the unwinding bobbin 11.

When the unwinding bobbin 11 supplies the entire wound straight grooved tube 10B, the unwinding bobbin 11 is removed and is replaced with another unwinding bobbin. The removed empty unwinding bobbin 11 is attached to an extrusion device for forming the straight grooved tube 10B and the straight grooved tube 10B is wound around the unwinding bobbin 11 again. The unwinding bobbin 11 is supported by the floating frame 34 and does not revolve. Therefore, even when the straight grooved tube 10B is scrambled by the unwinding bobbin 11, the straight grooved tube 10B can be supplied without trouble and can be used without rewinding. In addition, a rotation speed of a revolution for twisting the tube material 5 in the manufacturing device M is not limited due to weight of the unwinding bobbin 11. Therefore, a long tube material 5 can be wound around the unwinding bobbin 11. As a result, the long tube material 5 can be twisted, and manufacturing efficiency can be enhanced.

A brake unit 15 is provided in the bobbin support shaft 12. The brake unit 15 applies a braking force to the rotation of the bobbin support shaft 12 with respect to the floating frame 34. That is, the brake unit 15 restricts a rotation of the unwinding bobbin 11 in an unwinding direction. A rearward tension is applied to the tube material 5, which is conveyed in the unwinding direction, by the braking force of the brake unit 15. For example, as the brake unit 15, a powder brake or a band brake capable of adjusting torque as the braking force can be adopted.

(First Guide Capstan)

The first guide capstan 18 has a disk shape. The tube material 5 fed from the unwinding bobbin 11 is wound around the first guide capstan 18 one round. A tangential direction of an outer periphery of the first guide capstan 18 coincides with the revolution center axis C. The first guide capstan 18 guides the tube material 5 onto the revolution center axis C along a first direction D1.

The first guide capstan 18 is rotatably supported by the floating frame 34. In addition, rotatable guide rollers 18*b* are arranged side by side on an outer periphery of the first guide capstan 18. In the present embodiment, the first guide capstan 18 itself rotates and the guide rollers 18*b* roll. However, if either one rotates, the tube material 5 can be conveyed smoothly. In addition, the guide rollers 18*b* are not shown in FIG. 10.

As shown in FIG. 10, a tube guide portion 18*a* is provided between the first guide capstan 18 and the unwinding bobbin 11. For example, the tube guide portion 18*a* is a plurality of guide rollers disposed so as to surround the tube material 5. The tube guide portion 18*a* guides the tube material 5 supplied from the unwinding bobbin 11 to the first guide capstan 18.

Instead of the first guide capstan 18, a guide tube having a traverse function may be provided between the unwinding bobbin 11 and the first drawing die 1. When the guide tube is provided, it is possible to shorten a distance between the unwinding bobbin 11 and the first drawing die 1, and it is possible to effectively use a space inside a factory.

(First Drawing Die)

The first drawing die 1 reduces a diameter of the tube material 5 (straight grooved tube 10B). The first drawing die 1 is fixed to the floating frame 34. The first drawing die 1 has the first direction D1 as a drawing direction. A center of the first drawing die 1 coincides with the revolution center axis C of the rotary shaft 35. In addition, the first direction D1 is parallel to the revolution center axis C.

A lubricant is supplied to the first drawing die 1 by a lubricant supply device 9A fixed to the floating frame 34. Accordingly, it is possible to decrease a drawing force in the first drawing die 1.

The tube material 5 which has passed through the first drawing die 1 is introduced to the inside of the front shaft 35A via the through-hole provided in the front wall 34*b* of the floating frame 34.

(First Revolution Capstan)

The first revolution capstan 21 has a disk shape. The first revolution capstan 21 is disposed in a transverse hole 35Ac which radially penetrates the inside and the outside of the hollow front shaft 35A. In the first revolution capstan 21, a center of the disk is a rotary shaft J21, and the first revolution capstan 21 is supported by a support 21*a*, which is fixed to an outer periphery of the rotary shaft 35 (front shaft 35A), in a freely rotatable state.

In the first revolution capstan 21, one of tangent lines of the outer periphery approximately coincides with the revolution center axis C.

The tube material 5 conveyed in the first direction D1 on the revolution center axis C is wound around the first revolution capstan 21 more than one round. The first revolution capstan 21 winds the tube material 5, pulls out the tube material 5 from the inside of the front shaft 35A to the outside thereof, and guides the tube material 5 to the revolution flyer 23.

The first revolution capstan 21 revolves around the revolution center axis C together with the front shaft 35A. The revolution center axis C extends in a direction orthogonal to the rotary shaft J21 of the rotation of the first revolution capstan 21. The tube material 5 is twisted between the first revolution capstan 21 and the first drawing die 1. Accordingly, the tube material 5 becomes from the straight grooved tube 10B to the intermediate twisted tube 10C.

A drive motor 20 is provided in the first revolution capstan 21 and the front shaft 35A. The drive motor 20 drives and rotates the first revolution capstan 21 in a winding direction (conveyance direction) of the tube material 5. As a result, the first revolution capstan 21 applies a forward tension to the tube material 5 such that the tube material 5 passes through the first drawing die 1.

Preferably, the first revolution capstan 21 and the drive motor 20 are disposed symmetrically with respect to the revolution center axis C such that the center of gravity is positioned on the revolution center axis C of the front shaft 35A. Thereby, it is possible to stabilize a balance of a rotation of the front shaft 35A. In addition, in a case where a weight difference between the first revolution capstan 21 and the drive motor 20 increases, a weight may be provided to stabilize the center of gravity.

(Revolution Flyer)

The revolution flyer 23 reveres a pipeline of the tube material 5 between the first drawing die 1 and the second drawing die 2. The revolution flyer 23 reverses the tube material 5 conveyed in the first direction D1 which is the drawing direction of the first drawing die 1 and the conveyance direction becomes a second direction D2 which is the drawing direction of the second drawing die 2. More specifically, the revolution flyer 23 guides the tube material 5 from the first revolution capstan 21 to the second revolution capstan 22.

The revolution flyer 23 has a plurality of guide rollers 23*a* and a guide roller support (not shown) which supports the guide rollers 23*a*. Here, although the illustration of the guide roller support is omitted for the purpose of solving complication, the guide roller support is supported by the rotary shaft 35.

However, with respect to the structure of the flyer, the guide roller is not indispensable, and the flyer may be a plate-shaped structure for allowing the tube to pass therethrough and may have a shape with a ring attached to cause the tube to pass through the flyer. The ring may be provided on a plate-shaped member. A portion of the ring may be constituted by a portion of the plate-shaped member. Like the guide roller support, the plate-shaped member may be supported by the rotary shaft 35.

The guide rollers 23*a* are arranged to have an arc shape which is curved outward with respect to the revolution center axis C. The guide roller 23*a* itself rolls to convey the tube material 5 smoothly. The revolution flyer 23 rotates around the first drawing die 1 and the unwinding bobbin 11 supported in the floating frame 34 and the floating frame 34 with the revolution center axis C as a center.

One end of the revolution flyer 23 is located outside the first revolution capstan 21 with respect to the revolution center axis C. In addition, the other end of the revolution flyer 23 passes through a transverse hole 35Bc which radially penetrates the inside and outside of the hollow rear shaft 35B and extends into the inside of the rear shaft 35B. The revolution flyer 23 guides the tube material 5, which is wound around the first revolution capstan 21 and fed to the outside, to the rear shaft 35B side. In addition, the revolution flyer 23 feeds the tube material 5 on the revolution center axis C along the second direction D2 inside the rear shaft 35B.

In addition, in the present embodiment, the revolution flyer 23 conveys the tube material 5 by the guide rollers 23*a*. However, the revolution flyer 23 may be constituted by a band plate formed in an arc shape, and the tube material 5 may slide on one side of the band plate so as to be conveyed.

In addition, in FIG. 9, the case where the tube material 5 passes through outside the guide rollers 23*a* is exemplified.

However, in a case where a rotating speed of the revolution flyer 23 is high, the tube material 5 may be derailed from the revolution flyer by a centrifugal force. In this case, it is preferable to provide the guide rollers 23*a* outside the tube material 5.

A plurality of dummy flyers which have the same weight as that of the revolution flyer 23, extend from the front shaft 35A to the rear shaft 35B, and rotate synchronously with the revolution flyer 23 may be provided. Accordingly, the rotation of the rotary shaft 35 can be stabilized.

(Second Revolution Capstan)

The second revolution capstan 22 has a disk shape like the first revolution capstan 21. The second revolution capstan 22 is supported by the support 22*a*, which is provided at a tip of the end portion 35Bb of the rear shaft 35B, in a freely rotatable state. In addition, rotatable guide rollers 22*c* are arranged side by side on an outer periphery of the second revolution capstan 22. In the present embodiment, the second revolution capstan 22 itself rotates and the guide rollers 22*c* roll. However, if either one rotates, the tube material 5 can be conveyed smoothly.

In the second revolution capstan 22, one of tangent lines of the outer periphery approximately coincides with the revolution center axis C.

The tube material 5 conveyed in the second direction D2 on the revolution center axis C is wound around the second revolution capstan 22 more than one round. The second revolution capstan 22 feeds the wound tube material in the second direction D2 on the revolution center axis C.

The second revolution capstan 22 revolves around the revolution center axis C together with the rear shaft 35B. The revolution center axis C extends in a direction orthogonal to the rotary shaft J22 of the rotation of the second revolution capstan 22. The diameter of the tube material 5 fed from the second revolution capstan 22 is reduced in the second drawing die 2. The second drawing die 2 is stationary with respect to the ground G, and thus, the tube material 5 can be twisted between the second revolution capstan 22 and the second drawing die 2. Accordingly, the tube material 5 becomes from the intermediate twisted tube 10C to the inner surface spiral groove tube 10.

The support 22*a* which supports the second revolution capstan 22 supports a weight 22*b* at a position symmetrical to the second revolution capstan 22 with respect to the revolution center axis C. The weight 22*b* stabilizes a balance of a rotation of the rear shaft 35B.

(Second Drawing Die)

The second drawing die 2 is disposed in the subsequent stage of the second revolution capstan 22. The second drawing die 2 has the opposite second direction D2 as a drawing direction. The second direction D2 is a direction parallel to the revolution center axis C. The second direction D2 is opposite to the first direction D1 which is the drawing direction of the first drawing die 1. The tube material 5 passes through the second drawing die 2 along the second direction D2. The second drawing die 2 is stationary with respect to the ground G. A center of the second drawing die 2 coincides with the revolution center axis C of the rotary shaft 35.

For example, the second drawing die 2 is supported by the cradle 62 via a die support (not shown). In addition, a lubricant is supplied to the second drawing die 2 by a lubricant supply device 9B which is attached to the cradle 62. Accordingly, it possible to decrease a drawing force in the second drawing die 2.

By decreasing the diameter of the tube material 5 and twisting the tube material 5 in the second drawing die 2, the tube material 5 becomes from the intermediate twisted tube 10C to the inner surface spiral groove tube 10.

(Second Guide Capstan)

The second guide capstan 61 has a disk shape. A tangential direction of an outer periphery of the second guide capstan 61 coincides with the revolution center axis C. The tube material 5 conveyed in the second direction D2 on the revolution center axis C is wound around the second guide capstan 61 more than one round.

The second guide capstan 61 is rotatably supported by the cradle 62 about a rotary shaft J61. In addition, the rotary shaft J61 of the second guide capstan 61 is connected to a drive motor 63 via a drive belt or the like. The second guide capstan 61 is driven and rotated in the winding direction (conveyance direction) of the tube material 5 by the drive motor 63. In addition, preferably, the drive motor 63 uses a torque motor capable of controlling torque.

The forward tension is applied to the tube material 5 by driving the second guide capstan 61. Accordingly, drawing stress required for performing processing in the second drawing die 2 is applied to the tube material 5 and the tube material 5 is conveyed.

(Winding Bobbin)

The winding bobbin 71 is provided in a termination of the pipeline of the tube material 5 and winds the tube material 5. A guide portion 72 is provided in the preceding stage of the winding bobbin 71. The guide portion 72 has a traverse function and causes the tube material 5 to be aligned and wound around the winding bobbin 71.

The winding bobbin 71 is detachably attached to a bobbin support shaft 73. The bobbin support shaft 73 is supported by the cradle 75 and is connected to a drive motor 74 via a drive belt or the like. The winding bobbin 71 is driven and rotated by the drive motor 74 and winds the tube material 5 without slackness. In a case where the tube material 5 is sufficiently wound around the winding bobbin 71, the winding bobbin 71 is removed and is replaced with another winding bobbin 71.

<Twisting Step>

A method for the inner surface spiral groove tube 10 using the above-described manufacturing device M of the inner surface spiral groove tube will be described.

First, as a preliminary step, a straight grooved tube 10B is wound around unwinding bobbin 11 in a coil shape. In addition, the unwinding bobbin 11 is set in the floating frame 34 of the manufacturing device M. In addition, the tube material 5 (straight grooved tube 10B) is fed from the unwinding bobbin 11 and is set to the pipeline of the straight grooved tube 10B in advance. Specifically, the tube material 5 passes through the first guide capstan 18, first drawing die 1, the first revolution capstan 21, the revolution flyer 23, the second revolution capstan 22, the second drawing die 2, the second guide capstan 61, and the winding bobbin 71 in this order and is set.

The manufacturing step of the inner surface spiral groove tube 10 will be described along a conveyance path of the tube material.

First, the tube material 5 is sequentially fed from the unwinding bobbin 11. Next, the tube material 5 fed from the unwinding bobbin 11 is wound around the first guide capstan 18. The first guide capstan 18 guides the tube material 5 to the die hole of the first drawing die 1 positioned on the revolution center axis C (first guide step).

Next, the tube material 5 passes through the first drawing die 1. In addition, in the subsequent stage of the first drawing die 1, the tube material 5 is wound around the first revolution capstan 21 and is rotated around the rotary shaft.

As a result, the diameter of the tube material 5 is reduced and the tube material 5 is twisted (a first twist drawing step).

In the first twist-drawing step, the forward tension is applied to the tube material 5 by the drive motor 20 which drives the first revolution capstan 21. Moreover, at the same time, the rearward tension is applied to the tube material 5 by the brake unit 15 of the unwinding bobbin 11. Therefore, an appropriate tension can be applied to the tube material 5, and a stable twist angle can be applied to the tube material 5 without causing buckling or fracture.

After the tube material 5 passes through the first drawing die 1, the tube material 5 is wound around the first revolution capstan 21 which revolves. The diameter of the tube material 5 is reduced by the first drawing die 1 and the tube material 5 is twisted by the first revolution capstan 21. Accordingly, the linear grooves 4B (refer to FIG. 7) on the inner surface of the tube material 5 (straight grooved tube 10R) is twisted, and thus, the spiral grooves 4 are formed on the inner surface of the tube material 5. In the first twist-drawing step, the straight grooved tube 10B becomes the intermediate twisted tube 10C. The intermediate twisted tube 10C is a tube material is an intermediate step in the manufacturing step of the inner surface spiral groove tube 10, and in the intermediate twisted tube 10C, a spiral groove having a twist angle shallower than that of the spiral groove 4 of the inner surface spiral groove tube 10 is formed.

In the first twist-drawing step, the tube material 5 is twisted, and at the same time, the diameter of the tube material 5 is reduced by the drawing die. That is, composite stress is applied to the tube material 5 by simultaneous processing of the twisting and the diameter reduction. Under the composite stress, compared to a case where only the twisting processing is performed, yield stress of tube material 5 decreases, and the tube material 5 can be largely twisted before the tube material 5 reaches buckling stress. Accordingly, it is possible to largely twist the tube material 5 while suppressing occurrence of the bucking of the tube material 5.

In the preceding stage of the first drawing die 1, the first guide capstan 18 is provided, and the rotation of the tube material 5 is restricted. That is, in the preceding stage of the first drawing die 1, deformation of the tube material 5 in a twist direction is restricted. The tube material 5 is twisted between the first drawing die 1 and the first revolution capstan 21. That is, in the first twist-drawing step, a region (processing region) in which the tube material 5 is twisted is limited to a portion between the first drawing die 1 and the first revolution capstan 21.

There is a correlation between a length of the processing region and a limit twist angle (a maximum twist angle at which the tube material can be twisted without causing the buckling), and by shortening the processing region, the buckling is easily not generated even when a large twist angle is applied. By providing the first guide capstan 18, the twisting is not applied in the preceding stage of the first drawing die 1, and the processing region can be set short. In addition, the processing region is set short by decreasing a distance between the first drawing die 1 and the first revolution capstan 21, and the tube material 5 can be largely twisted without causing the buckling.

Preferably, a diameter reduction ratio of the tube material 5 by the first drawing die 1 is 2% or more. There is the correlation between the limit twist angle and the diameter reduction ratio, and the limit twist angle tends to increase as the diameter reduction ratio at the time of the drawing increases. That is, in a case where the diameter reduction ratio is too small, the effect of the drawing is poor, it is difficult to obtain a large twist angle, and thus, preferable, the diameter reduction ratio is set to 2% or more. In addition, from the same reasons, more preferably, the diameter reduction ratio is set to 5% or more.

Meanwhile, if the diameter reduction ratio is too large, the fracture easily occurs at a processing limit, and thus, preferably, the diameter reduction ratio is set to 40% or less.

Next, the tube material 5 is wound around the revolution flyer 23 and the conveyance direction of the tube material 5 becomes the second direction D2 on the revolution center axis C. In addition, the tube material 5 is wound around the second revolution capstan 22 and a tube material 5 is introduced to the second drawing die 2 (second guide step). Accordingly, the conveyance direction of the tube material 5 is reversed from the first direction D1 to the second direction D2 and is aligned with the center of the second drawing die 2. The revolution flyer 23 rotates about the revolution center axis C around the floating frame 34. In addition, the first revolution capstan 21, the revolution flyer 23, and the second revolution capstan 22 synchronously rotate about the revolution center axis C. Therefore, the tube material 5 does not relatively rotate and is not twisted between the first revolution capstan 21 and the second revolution capstan 22.

Next, the tube material 5 which rotates together with the second revolution capstan 22 passes through the second drawing die 2. As a result, the diameter of the tube material 5 is reduced and the tube material 5 is twisted, and thus, the twist angle of the spiral groove 4 is further increased (second twist-drawing step). In the second twist-drawing step, the intermediate twisted tube 10C becomes the inner surface spiral groove tube 10.

In the second twist-drawing step, the forward tension is applied to the tube material 5 by the drive motor 63 which drives the second guide capstan 61. In a case where the torque motor capable of controlling the torque is used as the drive motor 63, the second guide capstan 61 can adjust the forward tension applied to the tube material 5. It possible to apply an appropriate tension to the tube material 5 in the second twist-drawing step by adjusting the forward tension by the second guide capstan 61. Accordingly, a stable twist angle can be applied to the tube material 5 without causing buckling or fracture.

The tube material 5 is wound around the second revolution capstan 22 which revolves, and thereafter, passes through the second drawing die 2. The diameter of the tube material 5 is reduced by the second drawing die 2 and the tube material 5 is twisted by the second revolution capstan 22. As a result, the spiral grooves 4 on the inner surface of the tube material 5 are more largely twisted, and the twist angle of the spiral groove 4 increases. In the second twist-drawing step, the intermediate twisted tube 10C becomes the inner surface spiral groove tube 10.

In the preceding stage of the second drawing die 2, the tube material 5 is wound around the second revolution capstan 22. In the subsequent stage of the second drawing die 2, the second guide capstan 61 is provided and the rotation of the tube material 5 is restricted. That is, the deformation of the tube material 5 in the twist direction is restricted before and after the second drawing die 2, and the tube material 5 is twisted between the second revolution capstan 22 and the second guide capstan 61. That is, in the second twist-drawing step, a region (processing region) in which the tube material 5 is twisted is limited to a portion between the second revolution capstan 22 and the second drawing die 2. As described above, by shortening the processing region, the buckling is easily not generated even when a large twist angle is applied. By providing the second guide capstan 61, the twisting is not applied in the subsequent stage of the second drawing die 2, and the processing region can be set short.

In addition, in the present embodiment, the second revolution capstan 22 is provided behind the rear stand 37B (on the second drawing die 2 side). However, the second revolution capstan 22 may be positioned between the front stand 37A and the rear stand 37B. However, the second revolution capstan 22 is disposed behind the rear stand 37B so as to be close to the second drawing die 2, and thus, the processing region in the second twist-drawing step can be shortened. Therefore, it is possible to effectively suppress occurrence of the buckling.

In the second twist-drawing step, similarly to the first twist-drawing step, the twisting and the diameter reduction are performed, and a composite stress is applied to the tube material 5. As a result, before the tube material 5 reaches the buckling stress, the tube material 5 can be largely twisted while the occurrence of the buckling in the tube material is suppressed.

Similarly to the first twisting-drawing step, preferably, the diameter reduction ratio of the tube material 5 by the second drawing die 2 is 2% (more preferably, 5% or more) to 40%.

Moreover, in the first drawing die 1, if a large diameter reduction (for example, the diameter reduction ratio of 30% or more) is performed, the tube material 5 is work hardened, and thus, it is difficult to largely reduce the diameter by the second drawing die 2. Therefore, preferably, a sum of the diameter reduction ratio of first drawing die 1 and the diameter reduction ratio of the second drawing die 2 is 4% to 50%.

Next, the tube material 5 is wound around the winding bobbin 71 and recovered. The winding bobbin 71 rotates in synchronization with the conveyance speed of the tube material 5 by the drive motor 74, and thus, the tube material 5 can be wound without slackness.

<O-Material Materializing Step>

Next, the O-material materializing step (the annealed-aluminum-materializing step) will be explained.

The O-material materializing step is performed after the twisting step. The O-material materializing step is a heat treatment step in which an annealing treatment is performed on tube material 5. By performing the O-material materializing step, distortion of an aluminum material can be removed and internal stress can be removed.

A temperature, a holding time, and a cooling condition in the O-material materializing step are changed according to an aluminum alloy constituting the tube material 5. As an example, preferably, a heat treatment condition of the O-material-materialization processing is that the heat treatment is maintained for approximately one hour to three hours at 300° C. to 500° C. and the tube material is cooled at 30 C.°/hr. In addition, as described in the subsequent stage, the O-material-materialization processing may be performed simultaneously with the Zn diffusion step.

<Operation Effect>

According to the manufacturing method of the present embodiment, the straight grooved tube 10B is directly twisted, and thus, the Zn diffusion layer 6 and the fin 3 can be formed in a spiral shape at the same time. Accordingly, it is possible to manufacture the inner surface spiral groove tube 10 which simultaneously achieves an effect of suppressing warp when the tube is expanded by the spiral Zn diffusion layer 6 and an effect of improving a heat exchange rate by the spiral fins 3. That is, since an individual manufacturing step in which the Zn diffusion layer 6 and the fin 3 are respectively formed into a spiral shape is not required, it is possible to manufacture the inner surface spiral groove tube 10 having a high added value without increasing a manufacturing cost.

In the twisting step of the present embodiment, the first twist-drawing step and the second twist-drawing step may be again performed on the inner surface spiral groove tube 10 formed through the above-described steps to provide a larger twist angle. In this case, a heat treatment (annealing) is performed on the inner surface spiral groove tube 10 which is subjected to the above-described steps, and an O-materialized-material is formed. In addition, the inner surface spiral groove tube 10 is wound around the unwinding bobbin 11, and this unwinding bobbin 11 is attached to the manufacturing device M including the first drawing die and the second drawing die having an appropriate diameter reduction ratio. Furthermore, the inner surface spiral groove tube is subjected to steps (first twist-drawing step and second twist-drawing step) similar to the above-described steps by the manufacturing device M, and thus, it is possible to manufacture the inner surface spiral groove tube having a larger twist angle.

According to the twisting step of the present embodiment, the diameter reduction is performed simultaneously with the twisting, and thus, outer diameters and cross sectional areas of a starting material and a final product are different. In addition, the composite stress of the twisting and the diameter reduction is applied to the tube material, and thus, it is possible to reduce shear stress required for the twisting processing, and it is possible apply a large twist to the tube material 5 before reaching buckling stress of the tube material 5. Therefore, it is possible to manufacture the heat transfer tube having the fins 3 of the large lead angle θ1 and a thin bottom wall thickness without causing the buckling. It is possible to increase heat exchange efficiency by increasing the lead angle θ1 of the inner surface spiral groove tube 10. In addition, the bottom wall thickness of the inner surface spiral groove tube 10 decreases, and thus, the weight of the inner surface spiral groove tube 10 can be decreased and the inner surface spiral groove tube 10 can be made inexpensive by reducing a material cost. That is, according to the present embodiment, it is possible to manufacture the inner surface spiral groove tube 10 which is lightweight and inexpensive and has high heat exchange efficiency.

Moreover, according to the present embodiment, it is possible to manufacture the inner surface spiral groove tube 10 having the bottom wall thickness of 0.2 mm to 0.8 mm. In addition, according to the present embodiment, it is possible to manufacture the inner surface spiral groove tube 10 having the fins 3 with the lead angle θ1 of 10° to 45°.

According to the twisting step of the present embodiment, the straight grooved tube 10B is twisted and the diameter reduction is performed, and thus, it is possible to apply a large twist angle while suppressing occurrence of the buckling. Moreover, in the present embodiment, the outer diameter of the straight grooved tube 10B which is a material is 1.1 times or more the outer diameter of the inner surface spiral groove tube 10 which is the final product.

According to the twisting step of the present embodiment, the tube material 5 is twisted by the first revolution capstan 21 between the first drawing die 1 and the second drawing die 2. In addition, the drawing directions of first drawing die 1 and second drawing die 2 are opposite to each other. Accordingly, the twist direction of the first twist-drawing step and the second twist-drawing step coincide with each other, and the tube material 5 can be twisted. In addition, it is unnecessary to revolve unwinding bobbin 11 which is a beginning of the pipeline of the tube material 5 and the winding bobbin 71 which is a termination of the pipeline. Since a speed of the line depends on the rotating speed, in the twisting step of the present embodiment which does not rotate the unwinding bobbin 11 or the winding bobbin 71 which is heavyweight, it is possible to easily increase the rotating speed. That is, according to the present embodiment, the line speed can be easily increased.

Moreover, in the present embodiment, since the unwinding bobbin 11 is not revolved, it is possible to wind the long straight grooved tube 10B (tube material 5) around the unwinding bobbin 11. Therefore, according to the twisting step of the present embodiment, the long tube material 5 can be twisted at a stroke without replacing the unwinding bobbin 11. That is, according to the present embodiment, mass production of the inner surface spiral groove tube 10 is easily performed.

In the twisting step of the present embodiment, the tube material 5 is twisted through at least two twist-drawing steps. Accordingly, the twist angles applied in the twist-drawing step of each stage are stacked, and thus, a large twist angle can be applied.

According to the twisting step of the present embodiment, in the first twist-drawing step and the second twist-drawing step, the forward tension and the rearward tension are applied to the tube material 5. The forward tension is applied to the tube material 5 by the second guide capstan 61 and the rearward tension is applied to the tube material 5 by the brake unit 15 which brakes the unwinding bobbin 11. As a result, an appropriate tension can be stably applied to the tube material 5 of a processing target. There is no slackness in the pipeline of the tube material 5, the straight grooved tube 10B enters the drawing dies without misalignment, and thus, it is possible to apply a stable twist angle without causing the buckling and the fracture in tube material 5.

In the present embodiment, the centers of die holes of the first drawing die 1 and second drawing die 2 are positioned on the revolution center axis C. As a result, since the tube material 5 passing through the die holes can be disposed linearly with respect to the die holes, the diameter of the tube material 5 can be uniformly reduced and it is possible to suppress the buckling at the time of the twisting. Moreover, in the first drawing die 1 and the second drawing die 2, if the tube material 5 is in a range where the diameter of the tube material 5 can be reduced normally, misalignment of the die hole with respect to the revolution center axis C is permitted.

In the present embodiment, the unwinding bobbin 11 is supported by the floating frame 34 and the winding bobbin 71 is installed on the ground G However, any one of the unwinding bobbin 11 and the winding bobbin 71 may be supported by the floating frame 34. That is, in FIG. 9, the unwinding bobbin 11 and the winding bobbin 71 may be disposed to be interchanged with each other. In this case, the conveyance path of the tube material 5 is reverse. In addition, the first drawing die 1 and the second drawing die 2 are disposed to be interchanged with each other, and the drawing directions of the drawing dies 1 and 2 are disposed to be reverse along the conveyance direction. In addition, in the capstans positioned in front of and behind the drawing dies 1 and 2, the capstan positioned at the subsequent stage of the drawing die is driven in the winding direction (conveyance direction) of the tube material, and the forward tension against the drawing force in the drawing die is applied.

In the above-described twisting step, reasons for performing plastic processing by composite processing of the drawing and the twisting twice are as follows. Bending processing is performed at an entrance side of the drawing die during one-time processing and a shear stress is applied by unbending at a last portion of die approach. By performing the plastic processing twice, the bending and the unbending are repeated, and thus, the tube is work-hardened, and the tube is stably processed without the buckling when the tube is twisted. In addition, in order to uniformize the thickness of the Zn sprayed layer, which is thermally sprayed, in the circumferential direction, it is effective to perform two-times composite processing and repeat a leveling step at a die entrance, and this effect is larger than an effect when the drawing-twisting step is performed after the diffusion processing.

[Order of Each Step]

An order of each step in the method for manufacturing the heat transfer tube 10 will be described.

Here, a first manufacturing method A and a second manufacturing method B will be described.

<First Manufacturing Method>

The first manufacturing method A is performed in the following order (A1) to (A5).

(A1) Extrusion Molding Step (A2) Zn Thermal Spraying Step (A3) Zn Diffusion Step (A4) Twisting Step (A5) O-material materializing step According to the first manufacturing method A, since the Zn diffusion step is performed immediately after the Zn thermal spraying step, it is possible to perform the twisting step which is the subsequent state in a state where the Zn adhering to the surface of the raw tube 10B in the Zn thermal spraying step is fixed to the raw tube 10B. Accordingly, in the first manufacturing method A, there are advantages that the amount of Zn is easily decreased in the twisting step and the Zn concentration of the outer peripheral surface 10*a* of the heat transfer tube 10 easily increases.

<Second Manufacturing Method>

In addition, the second manufacturing method B is performed in the following order (B1) to (B4).

(B1) Extrusion Molding Step (B2) Zn Thermal Spraying Step (B3) Twisting Step (B4) Heating Treatment Step (Zn Diffusion Step and O-material materializing step)

According to the second manufacturing method B, it is possible to simultaneously perform the Zn diffusion step and the O-material materializing step. A heat treatment condition of the Zn diffusion step and a heat treatment condition of the O-material materializing step are similar to each other. Accordingly, it is possible to obtain the effect of the Zn diffusion step and the effect of the O-material materializing by one-time heat treatment step.

In addition, according to the second manufacturing method B, the Zn sprayed layer excessively adhered in the Zn thermal spraying step can be leveled by the Zn sprayed layer passing through the die in the twisting step. In the Zn thermal spraying step, since the Zn is injected to the raw tube 10B, an adherence amount of the Zn sprayed layer tends to become nonuniform along the length direction of the raw tube 10B. Therefore, in the Zn sprayed layer, a portion having a high Zn content may be locally formed. In addition, a portion where the Zn amount is extremely high may be easily corroded after the Zn diffusion. According to the second manufacturing method B, since the twisting step is performed without diffusing the Zn after the Zn thermal spraying step, the portion where the Zn amount locally increases passes through the die in the twisting step, and thus, Zn is scraped off and the Zn amount can be leveled. It is possible to manufacture the heat transfer tube 10 having a higher corrosion resistance.

Second Embodiment

Figure 11:
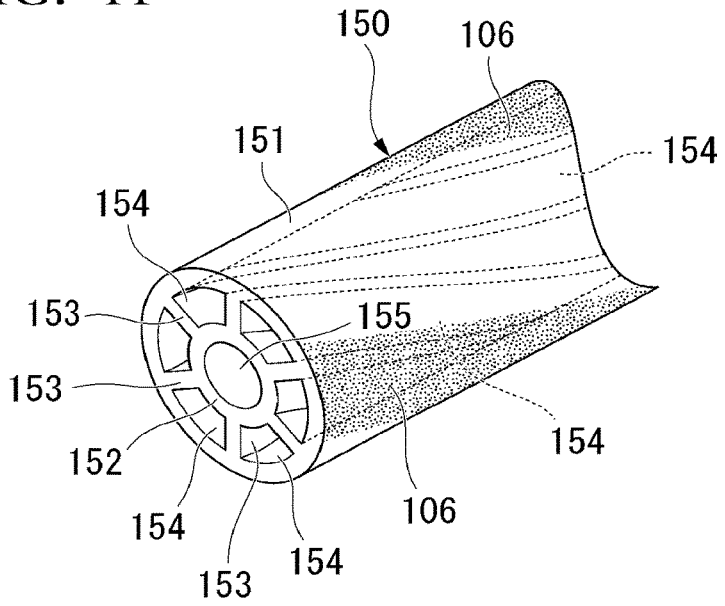
FIG. 11 is a perspective view of a heat transfer tube of a second embodiment.

FIG. 11 is a perspective view of a multiple twisted tube (heat transfer tube) 150 of a second embodiment.

In the present embodiment, the multiple twisted tube 150 includes an outer tube 151 and an inner tube 152, a plurality of partition walls 153 are radially formed at predetermined intervals in a circumferential direction of the inner tube 152, and the plurality of partition walls 153 are integrally connected to the outer tube 151 and the inner tube 152 and spirally extend in a length direction of the tube.

The partition walls 153 spirally extend, and thus, a plurality of twisted flow paths (first flow paths) 154, which are partitioned by the outer tube 151, the inner tube 152, and the partition walls 153, are formed outside the inner tube 152.

Moreover, a second flow path 155 is formed inside the inner tube 152.

Since the partition walls 153 formed outside the inner tube 152 are spirally formed at a predetermined twist angle and a predetermined spiral pitch along the length direction of the inner tube 152, the plurality of twisted flow paths 154 are spirally formed at a predetermined spiral pitch and a predetermined twist angle so as to surround a periphery of the inner tube 152.

In the present embodiment, six twisted flow paths 154 are formed around the inner tube 152, a diameter of the inner tube 152 is formed to be approximately half a diameter of the outer tube 151, and a height of the twisted flow path 154 along the radial direction of the outer tube 151 is formed to be approximately the same as a radius of the inner tube 152.

In the present embodiment, the streak-shaped Zn diffusion layers 106, which are spirally formed along the length direction, are provided on an outer peripheral surface of the outer tube 151. According to the multiple twisted tube 150 of the present embodiment, the spiral Zn diffusion layer 106 is provided, and thus, similarly to the first embodiment, even in the case where the rainwater or the dew condensation water is intensively accumulated in a portion of the outer peripheral surface in the circumferential direction, it is possible to obtain a sufficient corrosion resistance.

Similarly to the above-described first embodiment, the multiple twisted tube 150 of the present embodiment is formed of aluminum or an aluminum alloy. In addition, the multiple twisted tube 150 of the present embodiment can be manufactured by manufacturing a composite raw tube having a partition wall which is extends in a band plate shape between an outer tube and an inner tube along length directions of the tubes and is not formed in a spiral shape and twisting the composite raw tube by the manufacturing device M shown in FIG. 9.

In the multiple twisted tube 150 of the present embodiment, each of the first flow paths 154 and the second flow path 155 can be used as a flow passage of a refrigerant. In this case, it is possible to effectively perform heat exchange between the refrigerant flowing through the first flow paths 154 and the refrigerant flowing through the second flow path 155. In this case, the multiple twisted tube 150 itself functions as a heat exchanger. Moreover, one of the first and second flow path 154 and 155 can be used as a forward path, and the other thereof can be used as a return path.

In addition, in the present embodiment, a structure (partition wall) partitioning the inner flow paths including the inner tube 152 and the partition walls 153 is merely an example. The structure of the heat transfer tube is not limited as long as it is a heat transfer tube having a structure (partition wall), which forms at least one flow path to extend spirally along the length direction, inside the heat transfer tube.

EXAMPLE

A billet manufactured using JIS 3003 alloy was subjected to a homogenization treatment under a condition of 595° C. for 12 hours and, thereafter, was uniformly heated at 500° C., and thus, a raw tube for manufacturing a heat transfer tube was produced by hot extrusion. In the raw tube, an outer diameter was 9 mm, a bottom wall thickness was 0.5 mm, a fins height on an inner peripheral side was 0.16 mm, and the number of the fins was 45.

Zn thermal spraying was performed on the raw tube, which was subjected to the hot extrusion, as follows.

Zn Thermal Spraying: Various test materials were manufactured by performing the thermal spraying on the raw tube in two upper and lower directions of the raw tube, setting a raw tube extrusion speed to 20 to 60 m/min, controlling a current value of the Zn thermal sprayer, and changing the Zn adhesion amount or the Zn coverage.

A manufacturing method A (corresponding to the first manufacturing method A), a manufacturing method B (corresponding to the second manufacturing method B), and a manufacturing method C which does not apply the twisting were performed on the raw tube subjected to the Zn thermal spraying.

In the manufacturing method A, Zn was diffused into the raw tube, which was subjected to the Zn thermal spraying, under various conditions shown in the following Table 1, the raw tube was drawn and twisted, and thereafter, a heat treatment for stress removal was performed on the raw tube.

In the manufacturing method B, the raw tube subjected to the Zn thermal spraying was drawn and twisted, and thereafter, Zn was diffused into the raw tube under the various conditions shown in the following Table 1.

In the manufacturing method C, the raw tube subjected to the Zn thermal spraying was drawn, and thereafter, Zn was diffused into the raw tube under the conditions shown in the following Table 1.

Thereafter, the raw tube was drawn and twisted twice under the thermal spraying and finish-drawn, and thus, a spiral grooved tube having an inner diameter of 6.35 mm and an inner lead angle of 0° to 25° (Zn diffusion lead angle of 0° to 26.1°) was processed. In the processing, a composite processing speed for a first time was changed in a range of 6 to 45 m/min under a constant flyer rotating speed of 100 rpm. For a sample with the inner lead angle and the Zn diffusion lead angle of 0° C., the drawing die for a first time was performed at a line speed of 10 m/min under no rotation of the flyer.

After the twisting processing and a simple sinking processing, a diffusion heat treatment at 400° C. to 500° C. for 3 to 7 hours were performed.

TABLE 1

| No. | | Zn diffusion condition | Zn coverage (%) | Average Zn concentration (%) | Maximum Zn concentration (%) | Lead angel of Zn diffusion layer (°) | Average diffusion depth of 0.3% Zn concentration (μm) |
|---|---|---|---|---|---|---|---|
| 1 | Example | 450° C. × 5 hr | 55 | 6 | 15 | 8.4 | 140 |
| 2 | Example | 450° C. × 5 hr | 60 | 6 | 15 | 8.4 | 140 |
| 3 | Example | 450° C. × 5 hr | 70 | 6 | 15 | 8.4 | 140 |
| 4 | Example | 450° C. × 5 hr | 55 | 3 | 15 | 8.4 | 140 |
| 5 | Example | 450° C. × 5 hr | 55 | 9 | 15 | 8.4 | 140 |
| 6 | Example | 450° C. × 5 hr | 55 | 12 | 15 | 8.4 | 140 |
| 7 | Example | 450° C. × 4 hr | 55 | 6 | 15 | 8.4 | 90 |
| 8 | Example | 450° C. × 6 hr | 55 | 6 | 15 | 8.4 | 190 |
| 9 | Example | 450° C. × 7 hr | 55 | 6 | 15 | 8.4 | 240 |
| 10 | Example | 450° C. × 5 hr | 55 | 6 | 15 | 26.1 | 140 |
| 11 | Example | 450° C. × 5 hr | 55 | 6 | 15 | 15 | 140 |
| 12 | Example | 450° C. × 5 hr | 55 | 6 | 10 | 8.4 | 140 |
| 13 | Comparative Example | 450° C. × 5 hr | 30 | 6 | 15 | 8.4 | 140 |
| 14 | Comparative Example | 450° C. × 5 hr | 55 | 15 | 25 | 8.4 | 140 |
| 15 | Comparative Example | 450° C. × 5 hr | 55 | 1 | 3 | 8.4 | 140 |
| 16 | Comparative Example | 400° C. × 5 hr | 55 | 6 | 15 | 8.4 | 60 |
| 17 | Comparative Example | 500° C. × 5 hr | 55 | 6 | 15 | 8.4 | 300 |
| 18 | Comparative Example | 450° C. × 5 hr | 55 | 6 | 15 | 6.2 | 140 |
| 19 | Comparative Example | 450° C. × 5 hr | 55 | 6 | 15 | 3.7 | 140 |
| 20 | Comparative Example | 450° C. × 5 hr | 55 | 6 | 15 | 0 | 140 |
| 21 | Comparative Example | 450° C. × 5 hr | 55 | 6 | 20 | 0 | 140 |
| 22 | Comparative Example | 450° C. × 5 hr | 55 | 15 | 20 | 8.4 | 140 |

| | | Maximum corrosion depth | | Corrosion speed | | Manufacture |
|---|---|---|---|---|---|---|
| No. | | (μm) | Evaluation | ($mg/cm^2$) | Evaluation | method |
| 1 | Example | 85 | A | 15 | A | A |
| 2 | Example | 80 | A | 15 | A | B |
| 3 | Example | 70 | A | 20 | A | A |
| 4 | Example | 90 | A | 15 | A | A |
| 5 | Example | 100 | A | 15 | A | A |
| 6 | Example | 125 | A | 25 | A | A |
| 7 | Example | 75 | A | 20 | A | A |
| 8 | Example | 110 | A | 20 | A | A |
| 9 | Example | 140 | A | 20 | A | B |
| 10 | Example | 100 | A | 15 | A | A |
| 11 | Example | 120 | A | 15 | A | A |
| 12 | Example | 70 | A | 10 | A | B |
| 13 | Comparative Example | 250 | B | 60 | C | A |
| 14 | Comparative Example | 310 | C | 50 | B | A |
| 15 | Comparative Example | 400 | C | 40 | B | A |
| 16 | Comparative Example | 200 | B | 60 | C | A |
| 17 | Comparative Example | 280 | B | 60 | C | A |
| 18 | Comparative Example | 150 | B | 30 | B | A |
| 19 | Comparative Example | 200 | B | 90 | C | A |
| 20 | Comparative Example | 280 | B | 100 | C | C |

TABLE 1-continued

| | | | | | | |
|---|---|---|---|---|---|---|
| 21 | Comparative Example | 310 | C | 30 | B | C |
| 22 | Comparative Example | 250 | B | 40 | B | B |

<Evaluation>

The Zn diffusion was performed under various conditions shown in Table 1, and thus, the following measurements were performed after the diffusion processing.

Zn coverage was calculated based on a thermal spraying portion circumferential length/circumference×100.

A surface analysis of a Zn concentration distribution on the outer peripheral surface was performed by an EPMA, and values in the circumferential direction 72 was averaged. Diffusion depths in the circumferential direction in 0.3% Zn concentration were measured and averaged.

In order to evaluate a corrosion resistance of the test materials, SWAAT specified by ASTMG 85-A3 was performed for 2,000 hours to measure a maximum corrosion depth and a corrosion rate of the tube. In addition, in the manufacturing method C (empty tube), the Zn unsprayed layer was disposed so as to constitute the lower side. The results are shown in Table 1.

A case where the maximum corrosion depth was less than 150 μm was evaluated as A, a case where the maximum corrosion depth was equal to or more than 150 μm and less than 300 μm was evaluated as B, and a case where the maximum corrosion depth was 300 μm or more was evaluated as C. In addition, a case where the corrosion rate was less than 30 mg/cm$^2$ was evaluated as A, a case where the corrosion rate was equal to or more than 30 mg/cm$^2$ and less than 60 mg/cm$^2$ was evaluated as B, and a case where the corrosion rate was 60 mg/cm$^2$ or more was evaluated as C.

From Table 1, the following is understood.

(1) If the Zn coverage is less than 50%, the anticorrosive effect decreases, and the maximum corrosion depth increases.

(2) If the average Zn concentration is too low, the anticorrosive effect decreases, and the maximum corrosion depth increases. Meanwhile, if the average Zn concentration is too high, the corrosion rate increases. This tendency is also applied to the maximum Zn concentration.

(3) If the Zn diffusion depth is small, the Zn diffusion layer is exhausted early, and thus, the corrosion resistance becomes insufficient. In addition, if the Zn diffusion depth is large, early piercing is prevented, and the corrosion resistance is improved.

(4) If the Zn diffusion lead angle is 8° or more, the corrosion resistance is improved.

(5) Meanwhile, if the Zn coverage, the average Zn concentration, and the Zn diffusion depth are within the ranges of the present invention, the maximum corrosion depth and the corrosion rate, which are equal to or more than the corrosion resistance of a copper tube, are exerted.

Hereinbefore, the various embodiments of the present invention are described. However, the respective configurations and combinations thereof in the respective embodiments are merely examples, and additions, omissions, substitutions, and other modifications of configurations are possible within a range which does not depart from the gist of the present invention. In addition, the present invention is not limited to the embodiments.

INDUSTRIAL APPLICABILITY

According to the heat transfer tube, even in a case where rainwater or dew condensation water is intensively accumulated in a portion of an outer peripheral surface in a circumferential direction, and it is possible to obtain a sufficient corrosion resistance.

REFERENCE SIGNS LIST

1: drawing die, first drawing die
2: second drawing di
3, 3B: fin
4: spiral groove
4B: linear groove
5: tube material
6, 106: Zn diffusion layer
10: inner surface spiral groove tube (heat transfer tube)
81: expanded tube (heat transfer tube)
10*a*: outer peripheral surface
10*b*: inner peripheral surface
10B: straight grooved tube (raw tube)
10C: intermediate twisted tube
23: revolution flyer
80: heat exchanger
82: heat sink
82*a*: insertion hole
150: multiple twisted tube (heat transfer tube)
d: bottom wall thickness
D1: first direction
D2: second direction

The invention claimed is:

1. A heat transfer tube made of aluminum, comprising:

a streak-shaped Zn diffusion layer which is spirally formed on an outer peripheral surface of the tube along a longitudinal direction, wherein an outer diameter of the heat transfer tube is from 4 mm to 15 mm, wherein a bottom wall thickness of the heat transfer tube is from 0.2 mm to 0.8 mm, wherein a plurality of fins which are spirally formed along the longitudinal direction are provided on an inner peripheral surface of the heat transfer tube, and satisfying the following expression:

$$\tan\theta 2 = \frac{(\alpha + 2\pi\beta)\tan\theta 1}{\alpha},$$

wherein α indicates an inner peripheral length,

β indicates the bottom wall thickness,

θ1 indicates a lead angle of a fin, and

θ2 indicates a lead angle of the streak-shaped Zn diffusion layer.

2. The heat transfer tube according to claim 1, wherein the streak-shaped Zn diffusion layer is provided in a region of 50% or more of the outer peripheral surface.

3. The heat transfer tube according to claim 1, wherein an average Zn concentration of the outer peripheral surface is from 3 mass % to 12 mass %, wherein the average Zn concentration of the outer peripheral surface is obtained by:

cutting the heat transfer tube to obtain a suitable length in the longitudinal direction, and opening and deploying the heat transfer tube from a cut surface, and crushing horizontally to obtain a plate-like sample, placing the plate-like sample so that a cross section perpendicular to the longitudinal direction becomes a measurement surface, filling with a resin around the plate-like sample, polishing, and buffing, dividing the measurement surface into 72 equally spaced intervals, and performing a line analysis on a part of the plate-like sample from a surface layer on the outer peripheral side of each heat transfer tube to the inner peripheral side, and measuring on Al strength and the Zn concentration in 70 points at 5 μm pitch by Electron Probe Micro Analyzer; and calculating an average value of Zn concentration of 72 points as the average Zn concentration.

4. The heat transfer tube according to claim 1, wherein an average diffusion depth of 0.3% Zn concentration is from 80 μm to 285 μm.

5. The heat transfer tube according to claim 1, wherein the lead angle of the streak-shaped Zn diffusion layer is 8° or more.

6. The heat transfer tube according to claim 1, wherein the heat transfer tube is inserted into insertion holes of a plurality of heat sinks which are arranged to be parallel to each other at predetermined intervals, is expanded in a diameter, and thereby is connected to the heat sinks.

7. A heat exchanger comprising:

the heat transfer tube according to claim 1; and a heat sink which is connected to the heat transfer tube.

8. A method for manufacturing the heat transfer tube of claim 1, the method comprising:

performing Zn thermal spraying on an outer periphery of an aluminum raw tube in a linear streak shape along a longitudinal direction, wherein the aluminum raw tube has a plurality of fins linearly extending along the longitudinal direction on an inner peripheral surface of the aluminum raw tube;

performing a heat treatment on the aluminum raw tube to diffuse Zn into the aluminum raw tube and forming a Zn diffusion layer;

twisting the aluminum raw tube to form the plurality of fins and the Zn diffusion layer in a spiral shape along the longitudinal direction; and performing the heat treatment on the aluminum raw tube.

9. A method for manufacturing a heat transfer tube, the method comprising:

performing Zn thermal spraying on an outer periphery of an aluminum raw tube in a linear streak shape along a length direction, wherein the aluminum raw tube has a plurality of fins linearly extending along a length direction on an inner peripheral surface of the heat transfer tube;

twisting the aluminum raw tube to form the fins and a Zn sprayed layer in a spiral shape along the length direction; and performing a heat treatment on the aluminum raw tube to diffuse Zn into the aluminum raw tube, form a Zn diffusion layer, and form an O- materialized aluminum raw tube.

10. The method according to claim 8, wherein the twisting comprises, using a first drawing die having a first direction as a drawing direction, a second drawing die having a second direction opposite to the first direction as a drawing direction, and a revolution flyer which reverses a pipeline of a tube material between the first drawing die and the second drawing die from the first direction to the second direction and rotates around at least one selected from the group consisting of the first drawing die and the second drawing die, causing the aluminum raw tube having a plurality of linear grooves formed on an inner surface along the longitudinal direction to pass through the first drawing die, winding the aluminum raw tube around the revolution flyer, and revolving the aluminum raw tube to reduce a diameter of the aluminum raw tube and twist the aluminum raw tube so as to form an intermediate twisted tube, and causing the intermediate twisted tube rotating together with the revolution flyer to pass through the second drawing die to reduce a diameter of the intermediate twisted tube and twist the intermediate twisted tube.

11. The method according to claim 9, wherein the twisting comprises, using a first drawing die having a first direction as a drawing direction, a second drawing die having a second direction opposite to the first direction as a drawing direction, and a revolution flyer which reverses a pipeline of a tube material between the first drawing die and the second drawing die from the first direction to the second direction and rotates around any one of the first drawing die and the second drawing die, causing the aluminum raw tube having a plurality of linear grooves formed on an inner surface along the length direction to pass through the first drawing die, winding the aluminum raw tube around the revolution flyer, and revolving the aluminum raw tube to reduce a diameter of the aluminum raw tube and twist the aluminum raw tube so as to form an intermediate twisted tube, and causing the intermediate twisted tube rotating together with the revolution flyer to pass through the second drawing die to reduce a diameter of the intermediate twisted tube and twist the intermediate twisted tube.

* * * * *